US008333162B2

(12) United States Patent
Chapman et al.

(10) Patent No.: US 8,333,162 B2
(45) Date of Patent: Dec. 18, 2012

(54) COVERED MARINE DECK STRUCTURE FOR ROPE CONTACT

(75) Inventors: Randall F. Chapman, Elkton, MD (US); Frank M. Chapman, Elkton, MD (US); Paul Lippman, Linconville, ME (US)

(73) Assignee: Fluoron Inc., Elkton, MD (US)

( * ) Notice: Subject to any disclaimer, the term of this patent is extended or adjusted under 35 U.S.C. 154(b) by 127 days.

(21) Appl. No.: 12/806,403

(22) Filed: Aug. 12, 2010

(65) Prior Publication Data

US 2012/0037060 A1 Feb. 16, 2012

(51) Int. Cl.
*B63B 21/04* (2006.01)

(52) U.S. Cl. ..... 114/218

(58) Field of Classification Search ..... 114/218
See application file for complete search history.

(56) References Cited

U.S. PATENT DOCUMENTS 3,503,359 A * 3/1970 Cornwell, Jr. ..... 114/218
4,353,319 A * 10/1982 Ash ..... 114/218
5,286,952 A 2/1994 McMills et al.
5,529,012 A * 6/1996 Rytand ..... 114/263
6,120,074 A * 9/2000 Hamrick ..... 294/74
6,471,627 B2 10/2002 Chapman
6,948,440 B2 * 9/2005 Aschenbach ..... 114/219
2010/0101833 A1 * 4/2010 Zachariades et al. ..... 174/136

* cited by examiner

*Primary Examiner* — Stephen Avila
(74) *Attorney, Agent, or Firm* — ITP Services LLC

(57) ABSTRACT

A marine deck structure for rope contact having an impermeable cover for the purpose of preventing chaffing and wear of ropes is disclosed. Provided is a marine deck structure, such as a bullnose, or H-Bit covered with a durable impermeable cover that protects the structure from the harsh elements and provides a smooth low abrading surface. In another embodiment, rope chaffing surfaces on a marine vessel or dock are covered with an impermeable cover to reduce rope wear. The impermeable cover in one embodiment comprises ultra high molecular weight polyethylene (UHMWPE). A number of ways of covering the marine deck structures are provided, such as positioning cover sheets around or on the support member and attaching the cover by, for example, welding, adhering, or thermally shrinking.

24 Claims, 20 Drawing Sheets

COVERED MARINE DECK STRUCTURE FOR ROPE CONTACT

FIELD OF THE INVENTION

The invention relates to marine deck structures used for the directing, positioning, retaining, or fastening of ropes, and include structures such as but not limited to a bullnose, or H-bit, having a durable cover that reduces the wear and fraying of ropes.

BACKGROUND OF THE INVENTION

Marine vessels typically rely on ropes to secure and hold them to a dock or anchor, or for towing, and these ropes are usually positioned through or around a support or other structure for directing, positioning, retaining or fastening. These ropes become worn, abraded or chafed as they rub against the support structure which compromises their load holding capacity. When a rope breaks, the boat or ship held by the rope can drift; potentially causing damage to the boat or other structures. To prevent this, ropes are routinely replaced at a high cost.

Some ropes are large and very expensive, such as those used for towing large marine vessels, as for example those used on tug boats. In the case of a tug boat, large ropes are typically positioned through the bullnose, tied off to an H-bit and also tied off to a side bit. As the tug boat moves, the rope or ropes slide along the surface of the bullnose which causes abrasion or chafing. This chafing makes the ropes more susceptible to breaking. It is therefore important to inspect the ropes and replace them when they become damaged.

Marine vessels are exposed to extreme elements including, in some cases, salt water which corrodes the rope supports structures. Expensive maintenance is required for the rope support structures to minimize chipping paint, rust and rough surfaces that will accelerate the abrasion of the ropes.

Another method of reducing the abrasion or chafing of ropes is to cover the segment of the rope that will be in contact with sliding surfaces with a cylindrical fabric material. One such product is available from Taylor Made Group, LLC, Gloversville, N.Y. 12078. These products are difficult to install and can slip so that they no longer prevent rope contact with support structures. These products are difficult to manage, can make rope tensioning less responsive, are expensive and are not well suited for very large ropes that may have high forces exerted on supports.

There exists a need for reducing or eliminating chafing of ropes used for marine vessels. In particular, there exists a need to reduce the chafing of large ropes used on tug boats and other towing vessels where the ropes are directed, retained, positioned or fastened to marine structures such as a bullnose, H-bit, side bit or fairlead.

SUMMARY

The present invention provides a marine deck structure for rope contact having an impermeable cover for the purpose of preventing chaffing and wear of ropes. In some embodiments the marine deck structure has a cylindrically shaped support member and in some cases the support member is fixed and inaccessible on one or both ends. In some embodiments the impermeable cover has a seam extending over at least a portion of the length of the support member. In yet another embodiment, the impermeable cover has at least one twist resistant feature to prevent the cover from twisting under the high forces the ropes can exert. The marine deck structure can be a fairlead, bullnose, H-bit, side bit, fairlead roller, fairlead assembly, and the like. In another embodiment, rope chaffing surfaces on a marine vessel or dock are covered with an impermeable cover to reduce rope wear. The impermeable cover in one embodiment comprises ultra high molecular weight polyethylene (UHMWPE). A number of ways of covering the marine deck structures are provided, such as positioning cover sheets around or on the marine deck structure or support member and attaching the cover by, for example, welding, adhering, or thermally shrinking. In some embodiments, seams extend along a portion of the length of the support member or between cover sheets. A method to attach the edges of the cover sheet together, such as fusing is provided. In one embodiment there are multiple layers of cover sheet positioned around the marine deck structure and the layers are thermally fused together.

BRIEF DESCRIPTION OF THE DRAWINGS

The operation of the present invention should become apparent from the following description when considered in conjunction with the accompanying drawings, in which.

DETAILED DESCRIPTION

The present invention is directed to a covered marine structure for rope contact, and a method of covering. The marine structure is any metal structure attached to or part of a marine vessel or dock that is used for directing, positioning, retaining or fastening ropes or lines. On a marine vessel, the marine structure is typically located on or in the deck or deck walls. Marine structures that are located on a marine vessel include but are not limited to a fairlead, fairlead roller, fairlead roller assembly, bullnose, H-bit, side-bit, panama chock, sheave, cleat, and the like. Many marine structures are comprised of cylindrically shaped members, and some of the cylindrically shaped members rotate to facilitate the movement of the rope.

Figure 1:
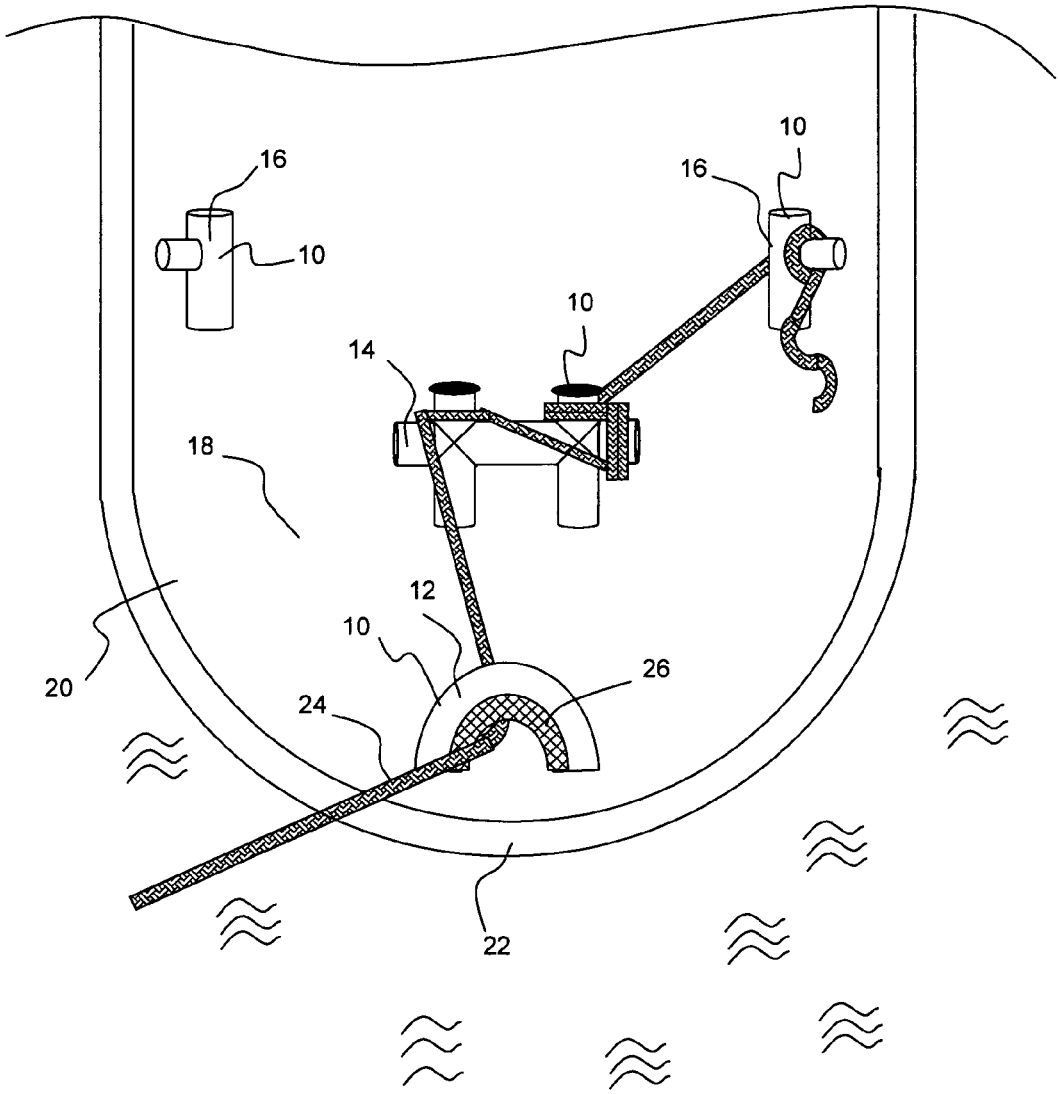
FIG. 1 is a top view of a marine vessel having marine structures for rope contact.
Figure 2:
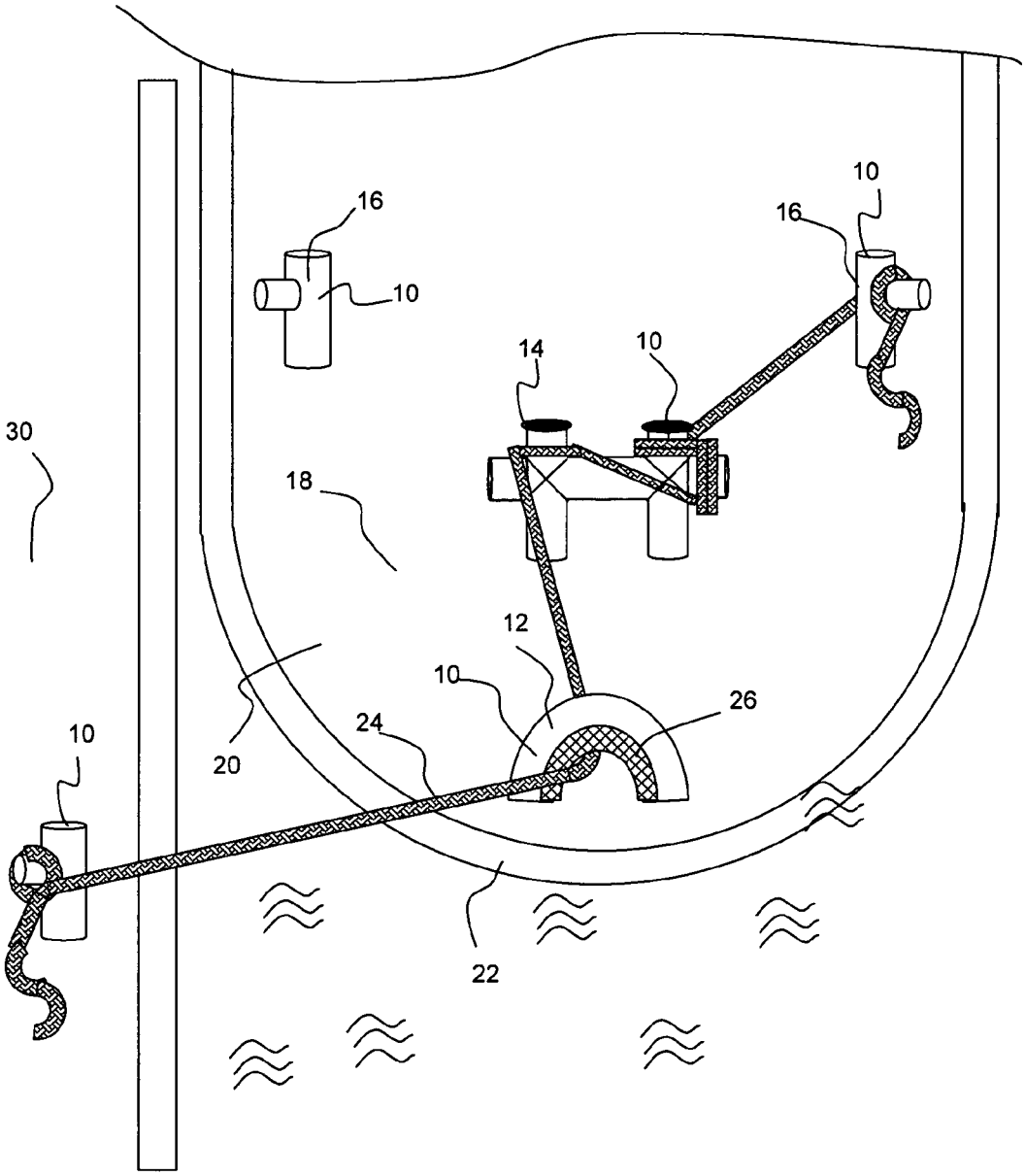
FIG. 2 is a top view of a marine vessel and dock having marine structures for rope contact.

As depicted in FIG. 1, the deck 18 of a marine vessel 20 comprises multiple marine structures 10 including a bullnose 12 located at the bow 22, an H-bit 14, and two side bits 16. The rope 24 is positioned through the bullnose 12 and pivots or slides over the rope contact surface 26 of the bullnose 12 as the vessel moves, as depicted in FIG. 1. After going through the bullnose 12, the rope 24 is then tied to the H-bit 14 and then tied off to the side bit 16 as depicted in FIG. 1. In an alternate embodiment, the rope 24 is tied off to a marine structure 10, on a dock 30 as depicted in FIG. 2.

Figure 3:
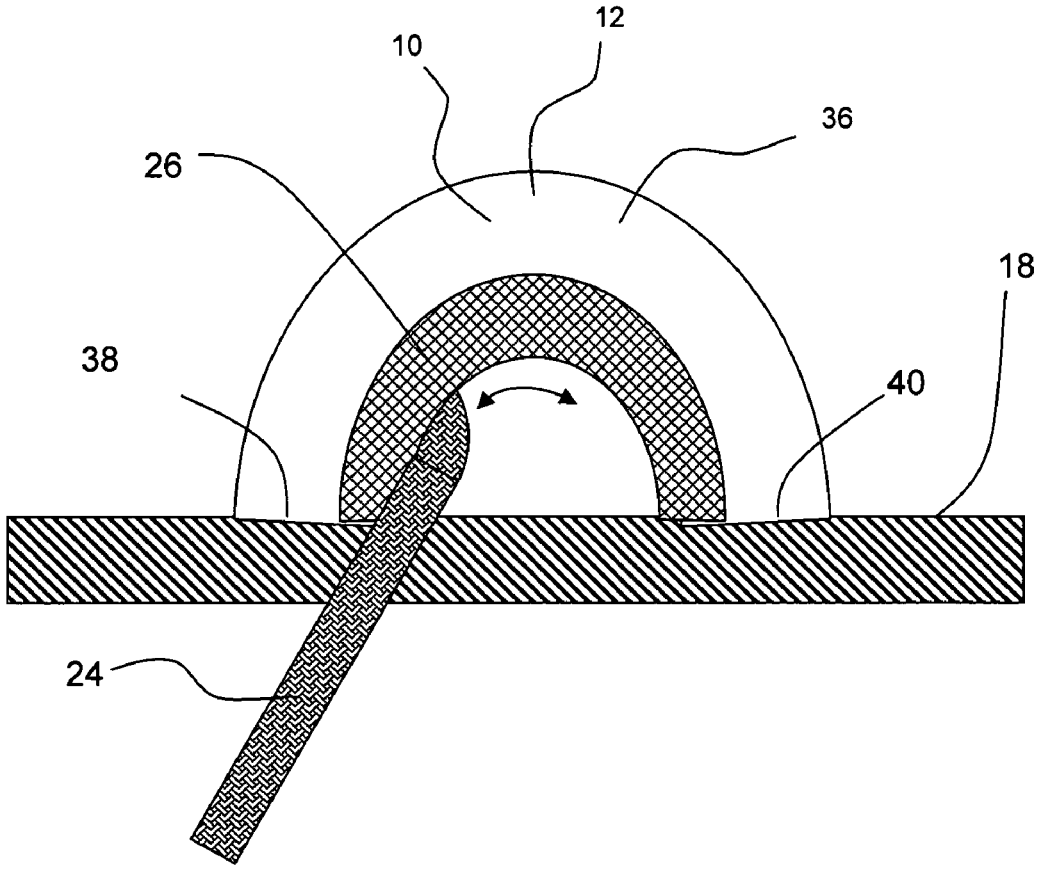
FIG. 3 is a front view of bullnose.

A bullnose 12 on a tug boat or other marine vessel is typically a cylindrically shaped support 36 in the shape of an arc, having a first end 38 and second end 40 attached to the marine deck 18 and is used for directing ropes 24 that extend away from the vessel, as depicted in FIG. 3. The rope 24 is free to slide within the opening of the bullnose and rubs against the inner radius or rope contact surface 26 as depicted in FIG. 3. The rope contact surface will vary depending on the position of the rope. Marine ropes are under very high tension and when they slide within the bullnose they can become chafed or abraded. It is critical that the ropes do not break while the towing vessel in under load. If the rope breaks while the towing vessel is towing another ship, serious injury can occur to the crew and the towed vessel can drift freely, be damaged or damage other vessels or structures. The surface of the bullnose can be rough due to welds between adjoining sections of metal used to construct the bullnose, general wear and tear including the high abrasion from ropes sliding across the surface, or from the harsh elements marine vessels often encounter.

Figure 4:
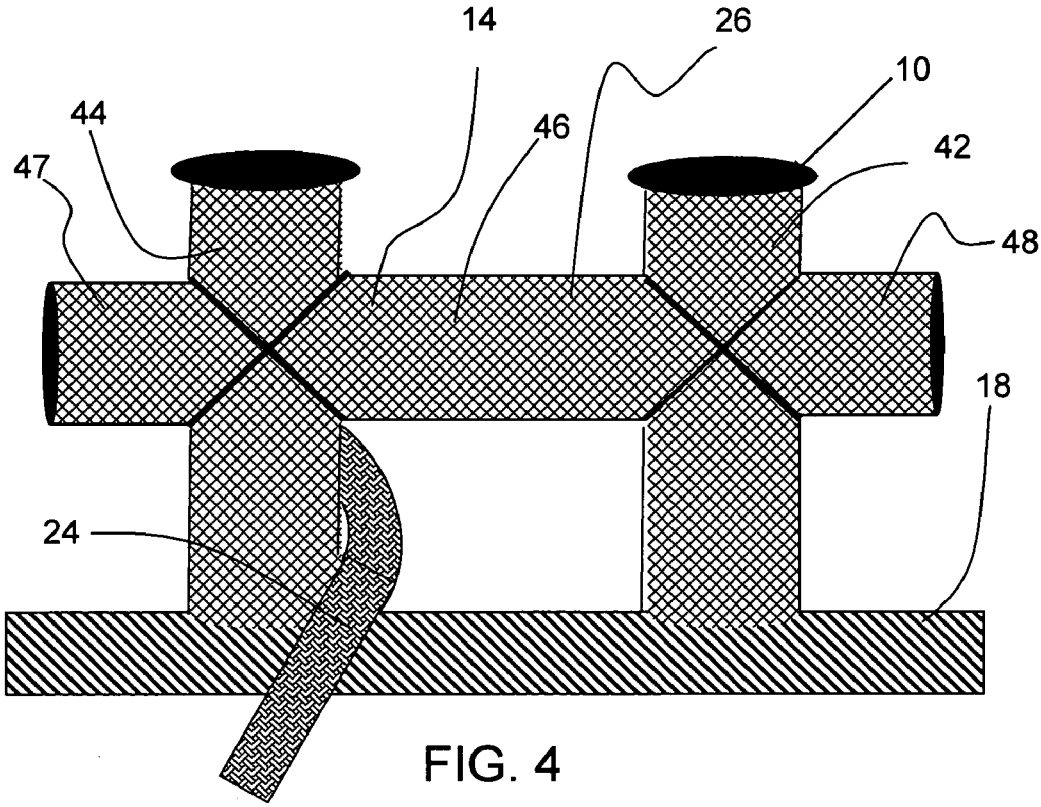
FIG. 4 is an isometric view of an H-bit.
Figure 5:
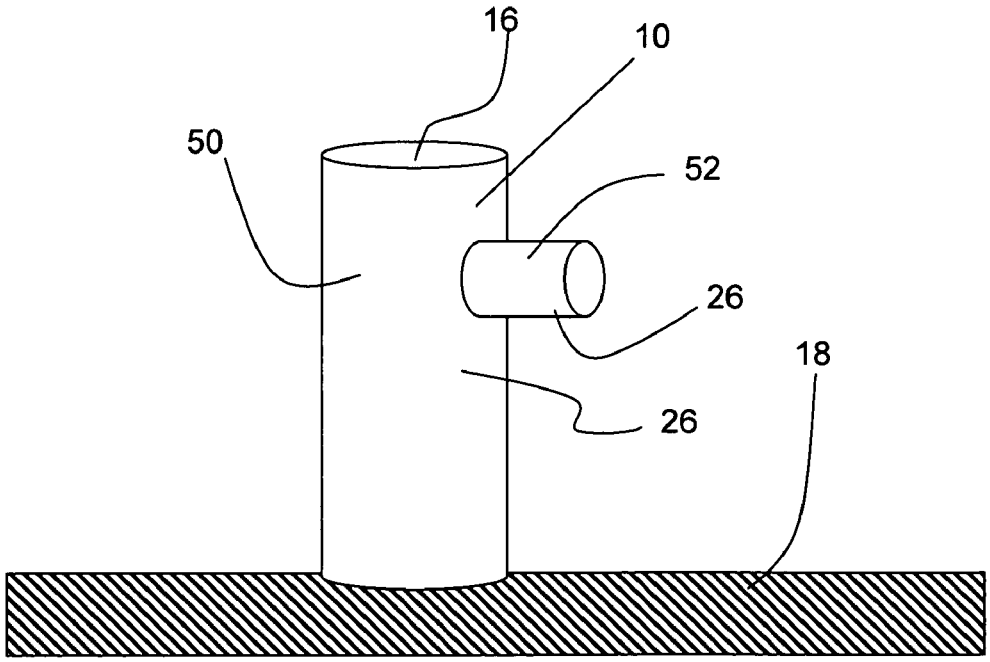
FIG. 5 is an isometric view of a side bit.

Two other common marine structures 10 are depicted in FIG. 4 and FIG. 5, and are an H-bit and side bit respectively. An H-bit usually comprises a first cylindrically shaped support member 42, a second cylindrically support member 44, and an adjoining horizontal cylindrically shaped support member 46, and optionally two additional horizontal cylindrically shaped support members 47 and 48 as depicted in FIG. 4. A side bit 16 comprises a first cylindrical support member 50 and a smaller cylindrical support member 52 positioned generally perpendicular to the first, typically referred to as the stopper, as depicted in FIG. 5. Again, the H-bit and side-bit can have a rough surface from exposure to elements, wear and tear, welds, and the like.

Figure 6:
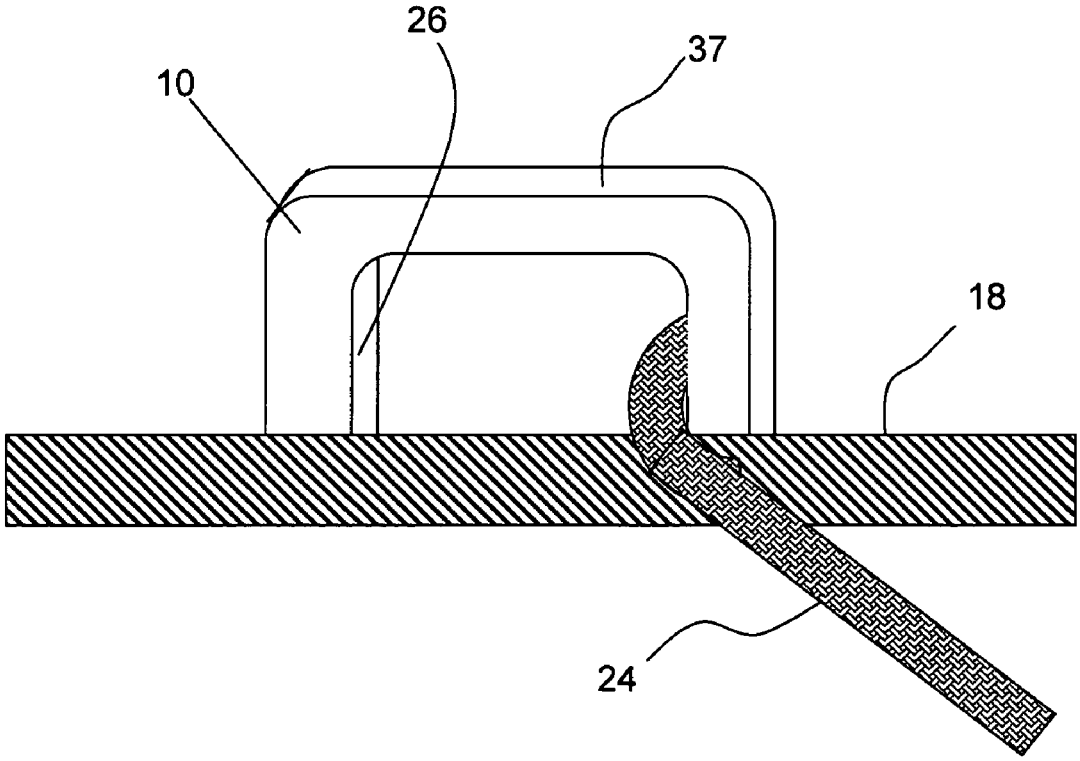
FIG. 6 is an isometric view of a marine structure.
Figure 7A:
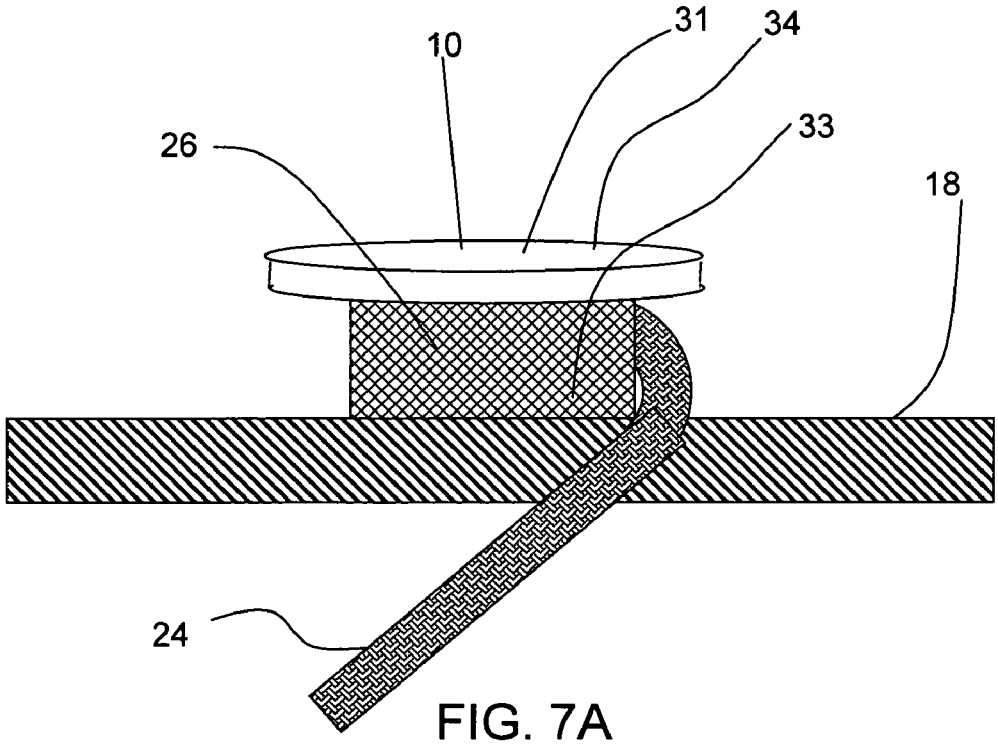
FIG. 7A is a front view of a another type of marine structure.
Figure 7B:
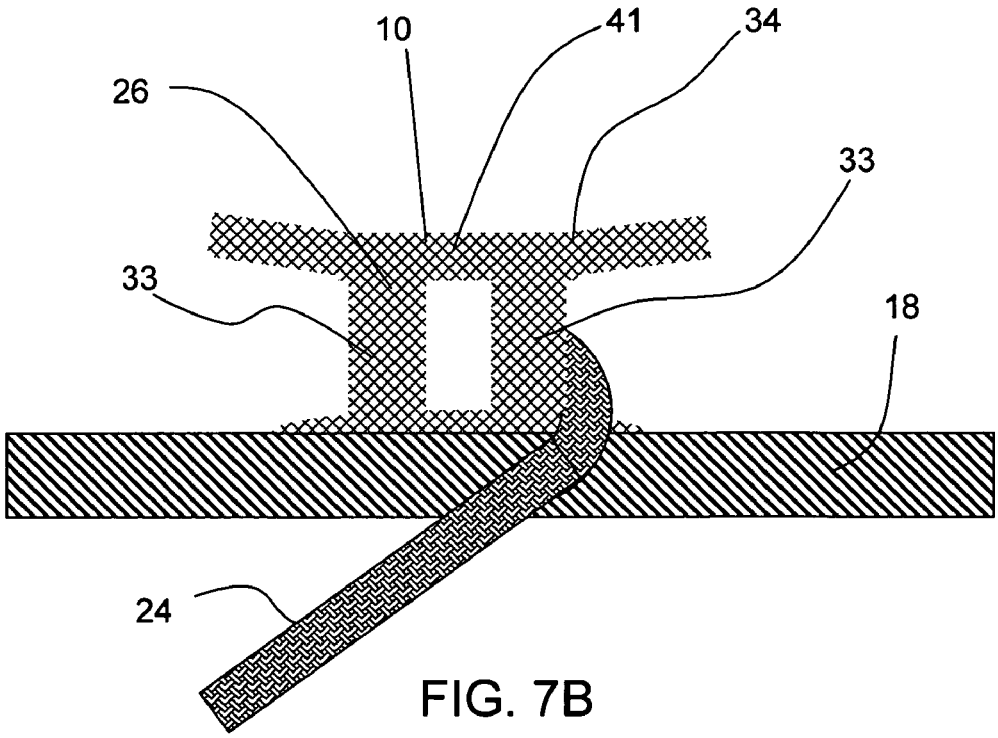
FIG. 7B is a front view of a cleat.
Figure 8:
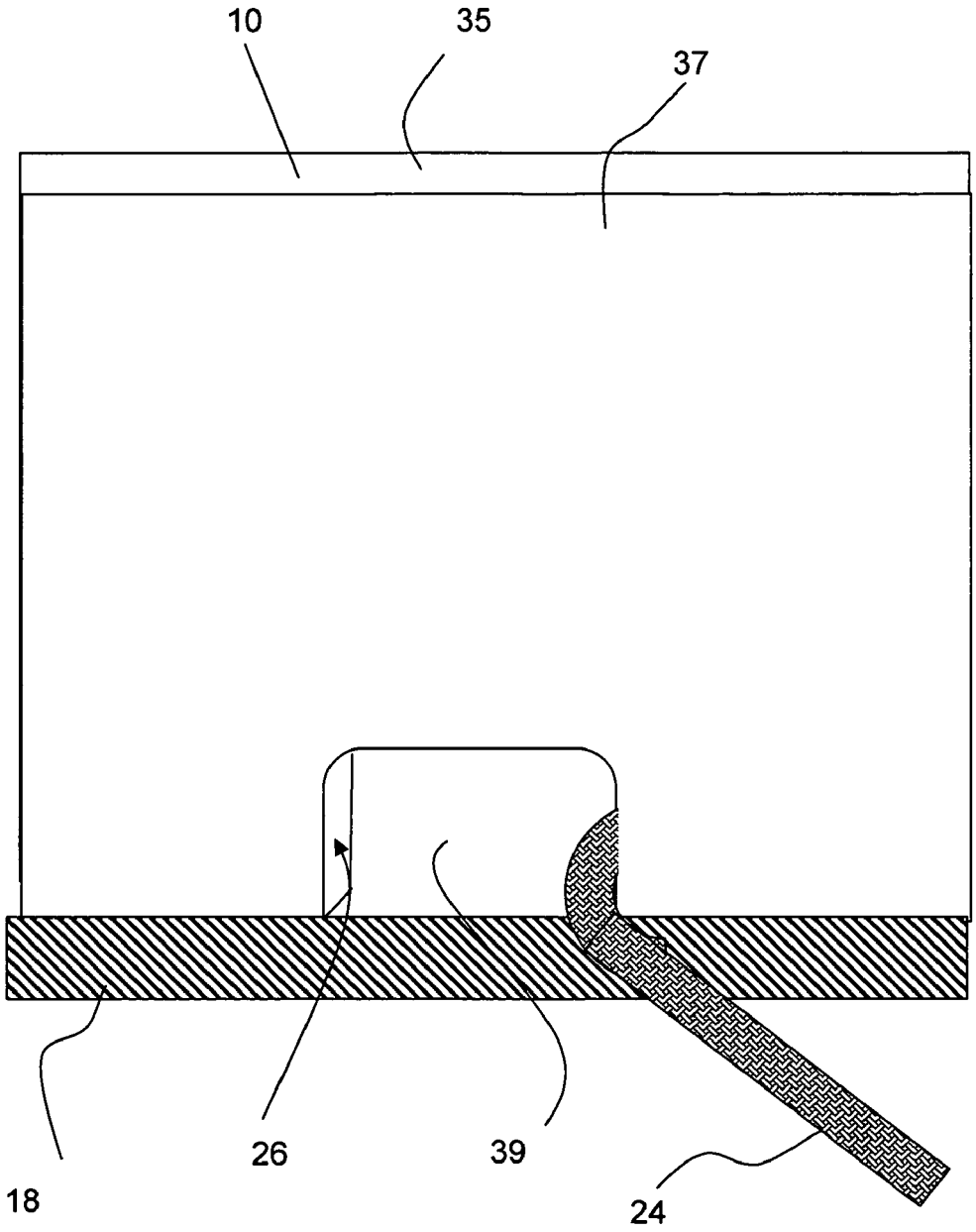
FIG. 8 is an isometric view of another type of marine structure.

Marine structures for rope contact do not always have cylindrical members as depicted in FIG. 6, where the support member 37 has a polygon, or rectangular cross section. Another example of a marine structure 10 is depicted in FIG. 7A, where a bit 31 comprises a vertical support member 33 attached to the vessel 18 and a horizontal support member 34 often referred to as a stopping cap. A similar example of a marine structure 10 is depicted in FIG. 7B, as a cleat 41 having two vertical support members 33 and a horizontal support member or cap 34. In some cases the marine structure does not comprise a cylindrical support member; for example where the deck wall 35 is the support member 37, having an opening 39 where a rope 24 can pass through as depicted in FIG. 8.

Figure 23:
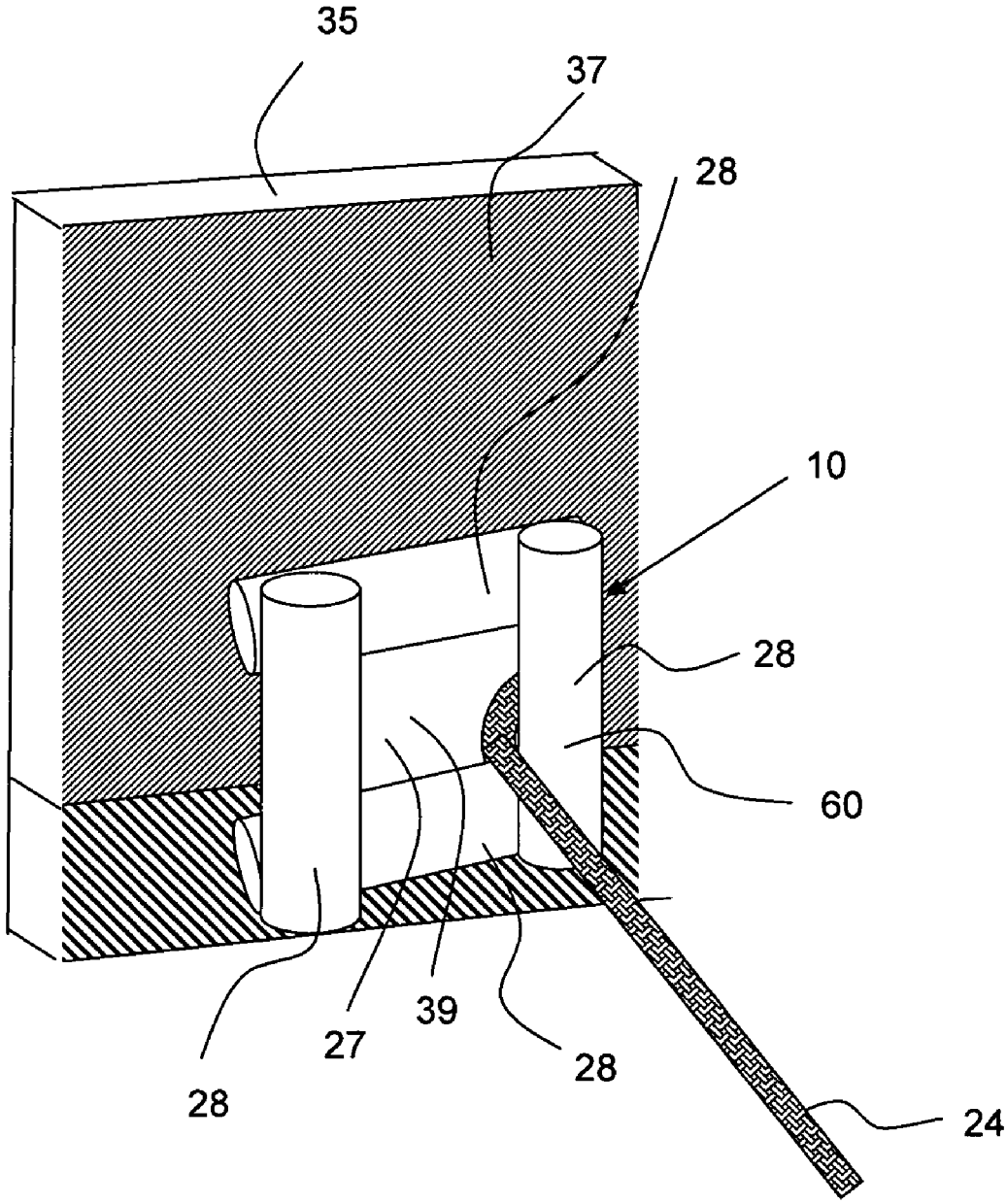
FIG. 23 is an isometric view of a covered fairlead having four fairlead rollers each with impermeable covers attached thereto.

In general, any opening in a marine structure through which a rope is guided, such as but not limited to those depicted in FIGS. 3, 4, 6 and 8, are referred to as a fairlead. A fairlead roller is a cylindrical member that is positioned in proximity to a fairlead, such that the rope passes over the surface of the fairlead roller as it passes through the fairlead, or opening. In some cases the fairlead roller rotates as the rope passes over it, thereby reducing friction and wear. In one embodiment, as depicted in FIG. 23, an assembly of fairlead rollers 28 is positioned around a fairlead 27 or opening 39 in a marine structure 10 such that a rope passing through the fairlead will pass over the surface of one of the fairlead rollers 28 regardless of the orientation of the rope 24. The marine structures described are but a few of the embodiments where ropes are directed, positioned, retained or fastened.

Figure 25:
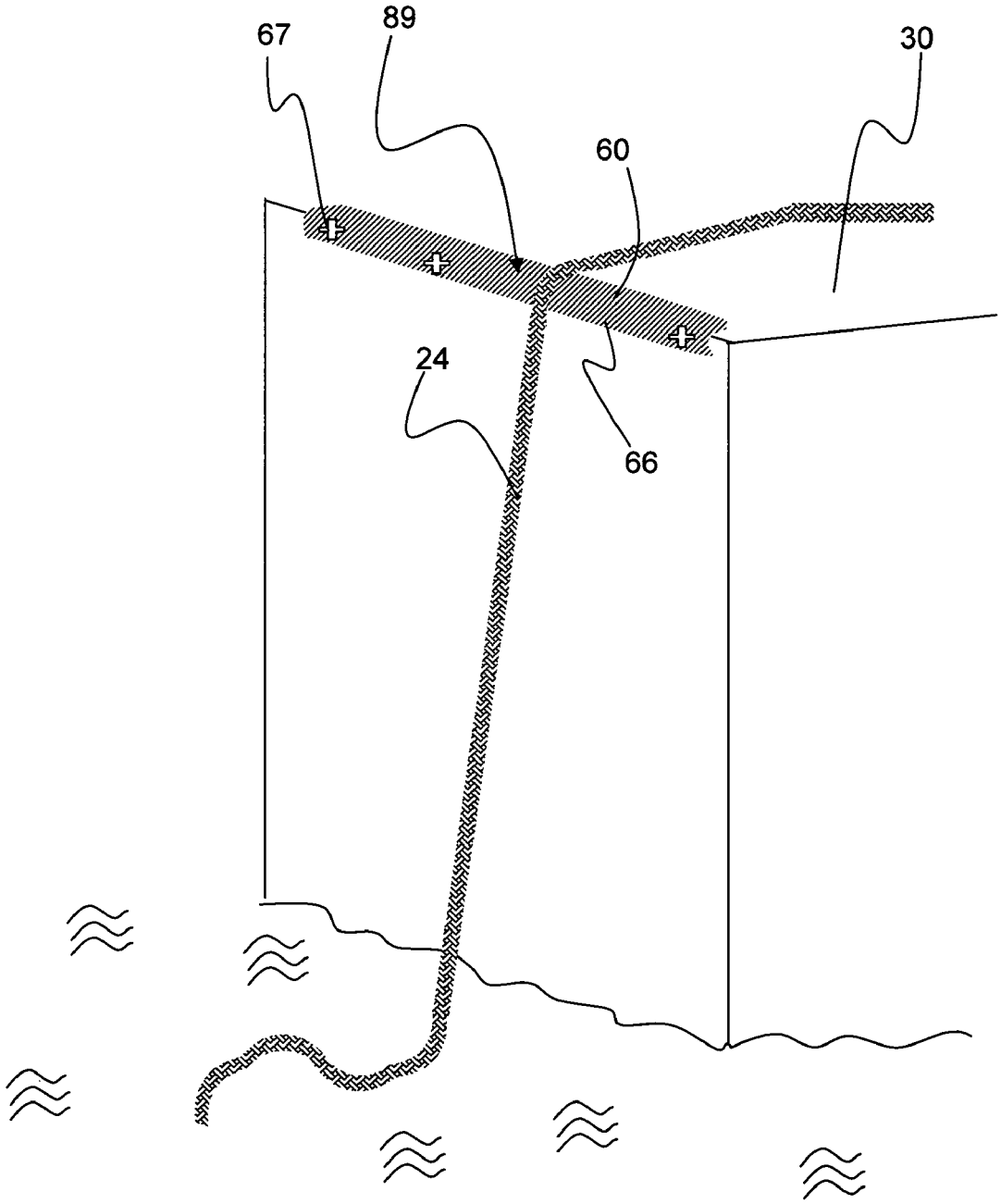
FIG. 25 is a side view of a rope chaffing surface on a dock.

In many cases ropes will come in contact with other surfaces and become chaffed, such as depicted in FIG. 25 where a chaffing surface 89 is depicted as a corner of a dock 30 where the rope 24 passes over, and may be dragged along the surface. It is important that on any given vessel and on the dock, to which it is tied off, chaffing surfaces with frequent rope contact have low abrasion characteristics or the rope will become worn and may fail. A cover sheet 60 is depicted as covering the chaffing surface 89 to create an impermeable cover 66 in FIG. 25. The cover sheet could be fastened to the chaffing surface with an adhesive, fastener 67, or twist resistant feature.

Figure 9:
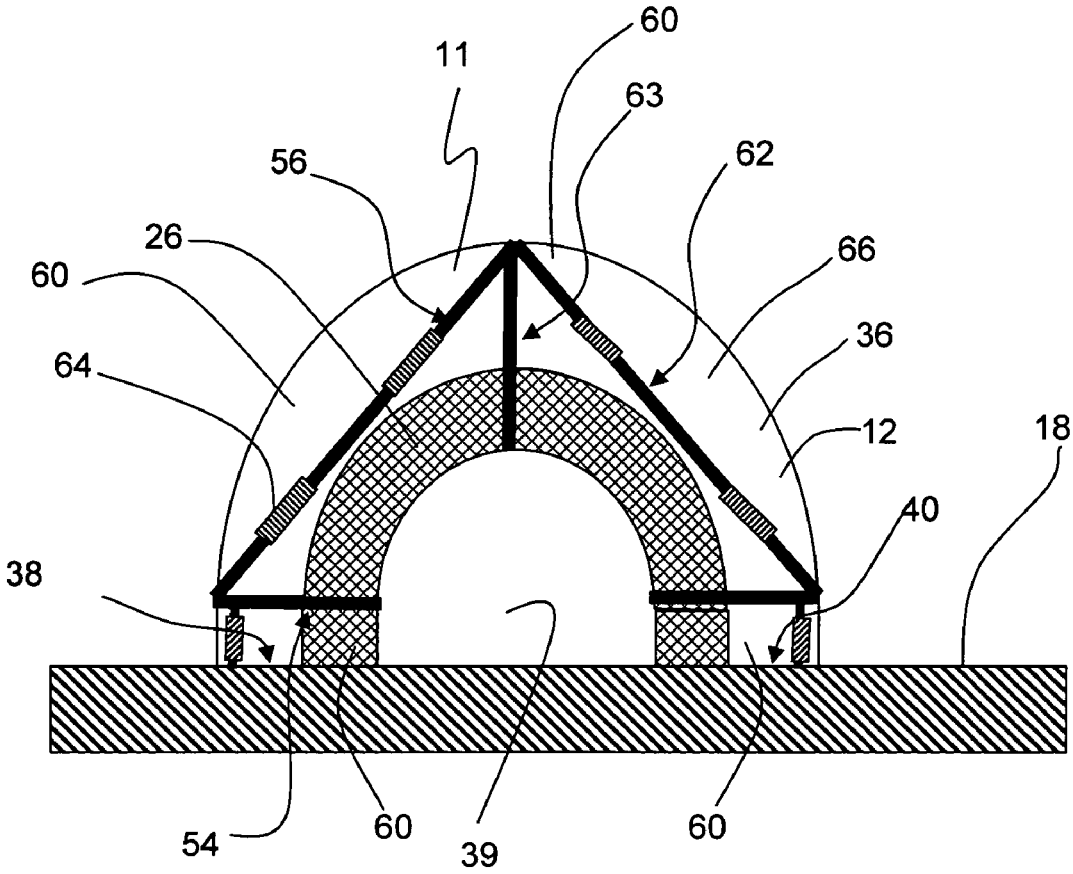
FIG. 9 is a front view of bullnose with an impermeable cover.
Figure 10:
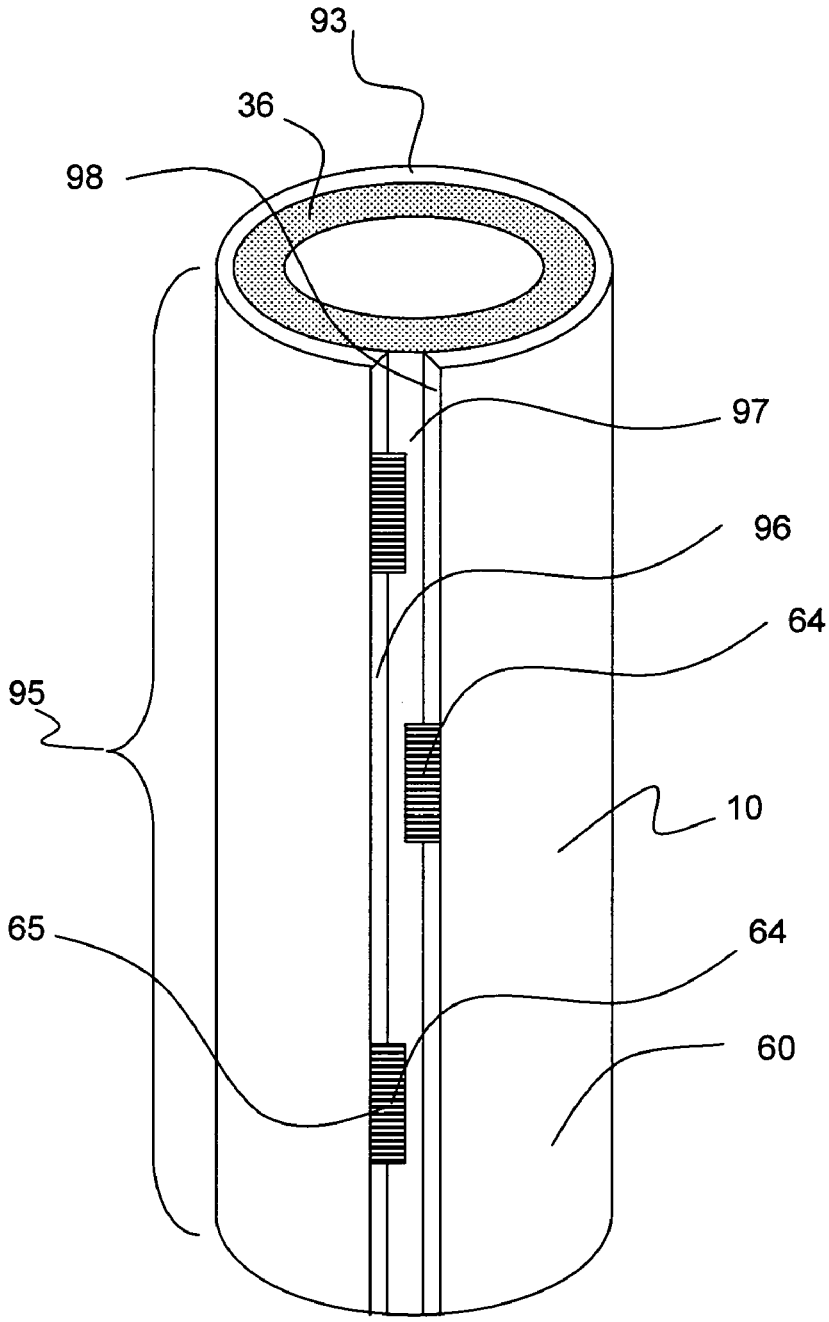
FIG. 10 is an isometric view of a cylindrical support and cover sheet.
Figure 11:
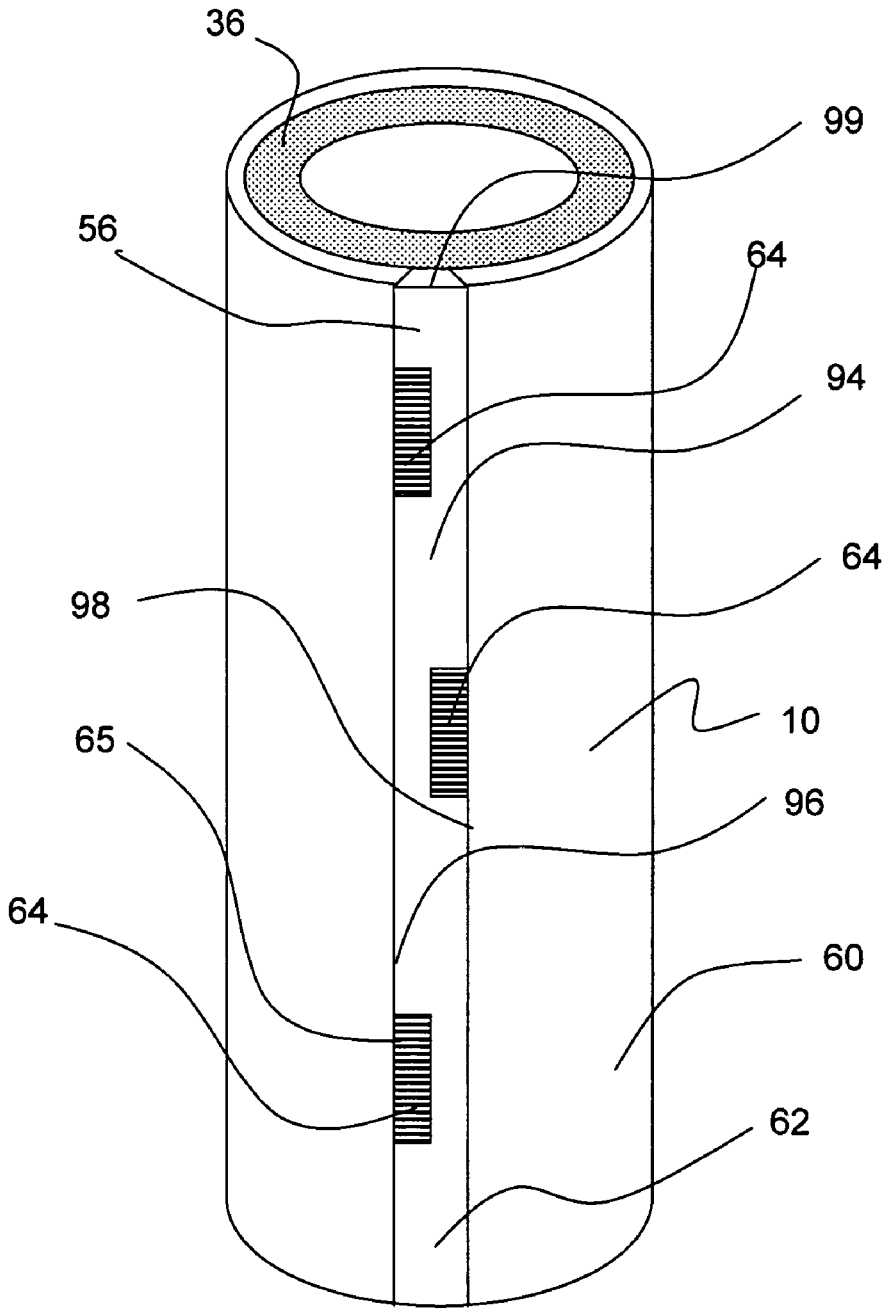
FIG. 11 is an isometric view of a cylindrical support and cover with an adhesive seam.

One embodiment for reducing the abrasion or chafing of ropes is depicted in FIG. 9, where the bullnose 12 is a covered marine structure 11 comprising an impermeable cover 66 that consists of multiple cover sheets 60 that are attached together at axial seams 62 and radial seams 63. Seams that go around the circumference of the support member are herein referred to as radial seams 63 and seams that run essentially along the axis of the support member are herein referred to as axial seams 62 as depicted in FIG. 9. This covered marine structure 11 further comprises multiple twist resistant features 64, depicted in FIG. 9 as metal supports welded to the bullnose 12 in the seam areas. In one embodiment the cover sheets 60 are tubular in shape, having a split along the length 95 creating a first edge 96, second edge 98 and gap 97 as depicted in FIG. 10. When the cover sheets 60 are of this tubular shape, they can be positioned around the cylindrical support member 36, and either welded together directly to form an integral seam 54 as depicted in FIG. 9, or an seam adhesive 99 can be used to attach the first edge 96 and second edge 98 creating an adhesive seam 56, as depicted in FIG. 11 and FIG. 9. The impermeable cover 66 may comprise a combination of seam types such as an adhesive seam 56 and an integral seam 54 as depicted in FIG. 9. In a preferred embodiment, the seams of the covered marine structure are located outside of the rope contact area 26 as depicted in FIG. 9. When the rope is under load or tension, it presses against the impermeable cover creating higher stress in these areas. Because of this, it is desirable to avoid having an axial seam 62 in these areas.

In one embodiment, multiple metal features such as metal blocks 65 or elbows are welded to the cylindrical support member 36 and act to resist twisting of the cover sheet 60 as depicted in FIG. 10. In one embodiment a twist resistant feature is an elbow that is welded or bolted to the support member having a perpendicular section facing away from the support member that acts as a stop for the cover sheet. In addition, the elbow can be positioned on the support structure along an edge of the cover sheet; therein providing a stop.

Figure 12:
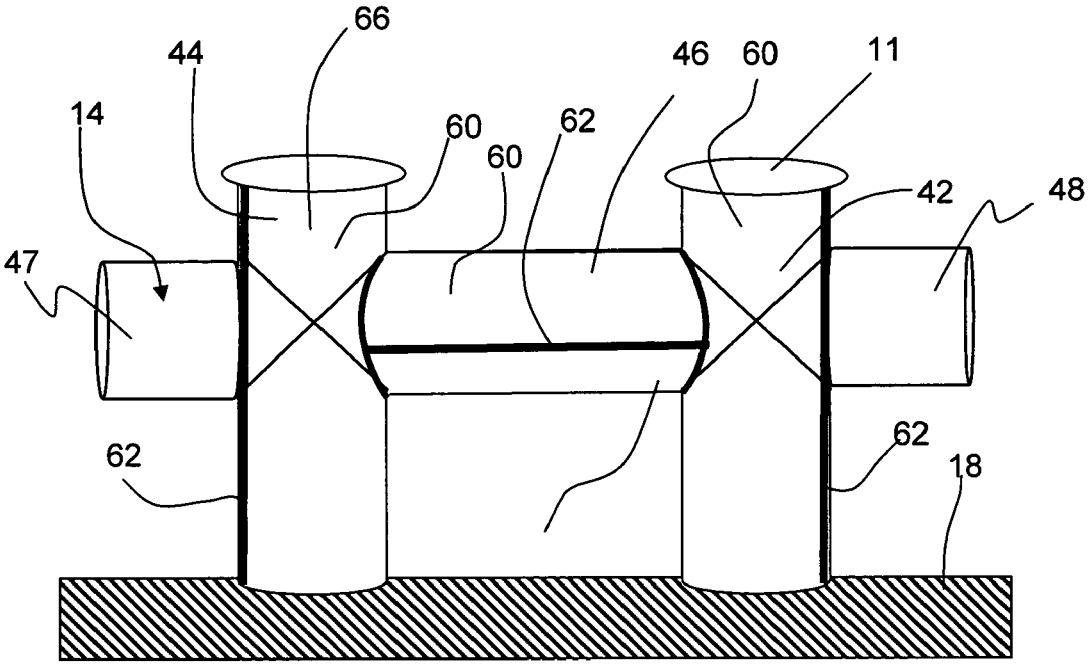
FIG. 12 is an isometric view of an H-bit with multiple cover sheets attached thereto.

The covered H-bit type marine structure 11 depicted in FIG. 12 has an impermeable cover 66 comprising three cover sheets 60 having axial seams 62. The axial seams 62 on the first and second support members 42, 44 are preferably positioned such that they intersect the additional horizontal support members 47, 48 as depicted in FIG. 12. The additional horizontal support members 47, 48 can be covered with cylindrical cover sheets or in some cases a cover tube, requiring no seam along the axis, and the exposed ends of the additional horizontal support members can be covered at least partially with excess length of the cover sheet or tube, or left exposed, as little to no rope contact occurs in this area. The side bit 16 depicted in FIG. 13, has an axial seam 62 that intersects the smaller diameter cylindrical support member 52, or stopper.

Figure 14:
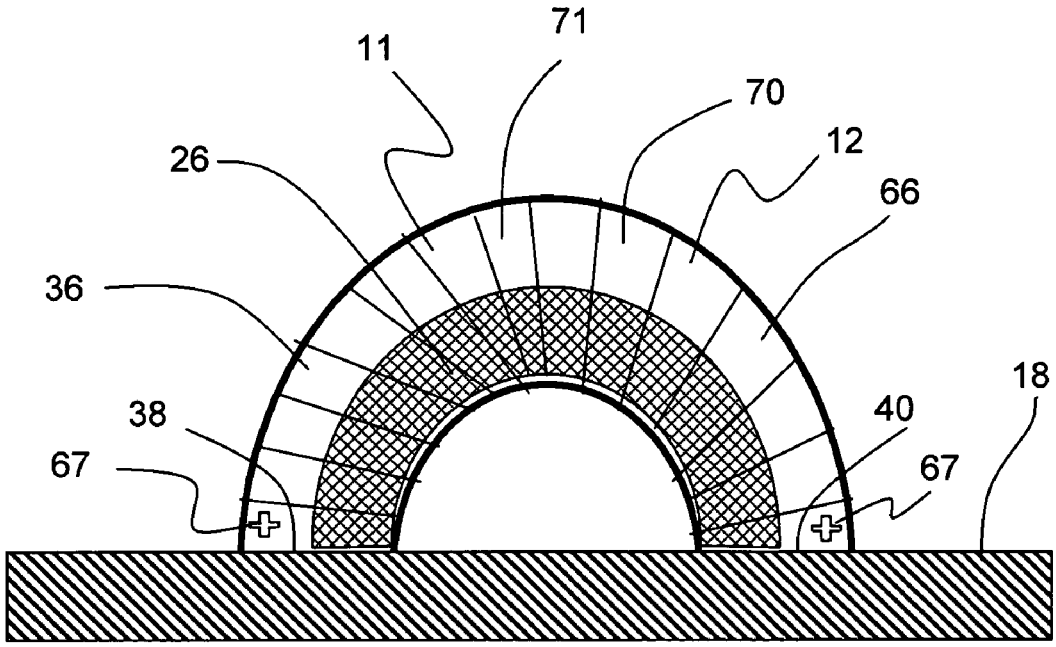
FIG. 14 is a front view of a bullnose having a spirally wrapped cover sheet applied thereto.

In one embodiment, a covered marine structure 11 is created by wrapping a cover sheet 70 around a support member 36 as depicted in FIG. 14. In the embodiment depicted in FIG. 14, a spirally wrapped cover sheet 70 is wrapped around a bullnose 12 leaving an overlap 71 that can be sanded down if required to create a smoother finish on the impermeable cover 66. The wrapped cover sheet material may be wrapped in such a way to leave no overlap and an integral or adhesive seam may be used to attach the edges of the cover sheet. Alternatively, the wrapped cover sheet may be wrapped in such a manner to provide multiple layers of cover sheet on the support member. In this embodiment, thinner cover sheet materials may be more desirable, such as less than 5 mm, or less than 3 mm, or less than 2 mm. The spirally wrapped cover sheet may be heated to bond the layers together using any conventional heating method such as but not limited to hot air, contact heating, inductive heating, ultrasonic heating, resistive heating and the like. The side bit 16 depicted in FIG. 15 also has a spirally wrapped cover sheet 70 having overlaps 71. Likewise, the covered marine structure 11 depicted in FIG. 16 comprises spirally wrapped cover sheets 70.

Figure 17:
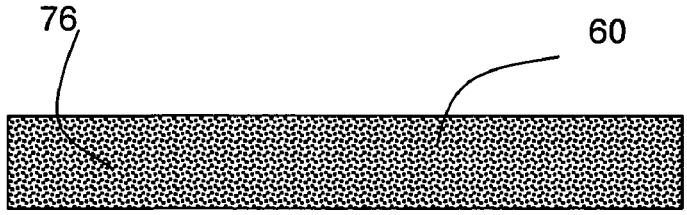
FIG. 17 is a cross section view of cover sheet material having filler.
Figure 18:
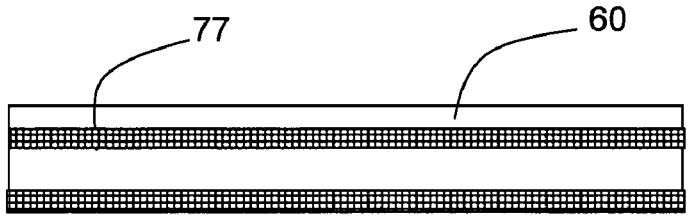
FIG. 18 is a cross section view of cover sheet material having a conductive network.

In one embodiment, as depicted in FIG. 17, the cover sheet comprises an electrically conductive filler 76 such as carbon or aluminum, or the like, that makes the cover sheet 60 capable of being heated using electric current and the layers or seams are attached by running a current through or across the thickness of the material as described in U.S. Pat. No. 5,286,952 to McMills et al. In a similar embodiment, as depicted in FIG. 18, the cover sheet 60 further comprises an electrically conductive network 77 such as a metal mesh or woven wire cloth, either in or on the surface of the cover sheet and electric current is used to create enough heat to bond or fuse the layers of the cover sheet together.

Figure 19:
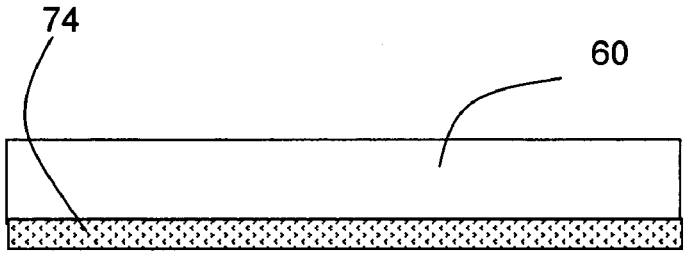
FIG. 19 is a cross section view of cover sheet material having an adhesive attached thereto.
Figure 20:
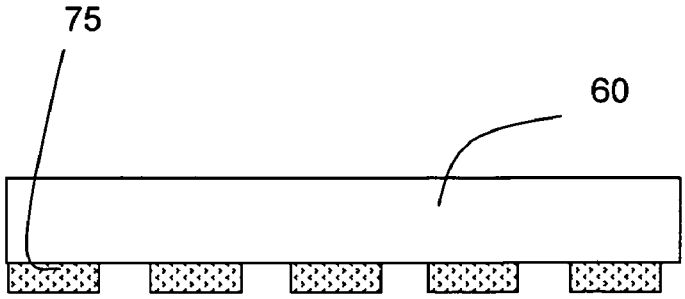
FIG. 20 is a cross section view of cover sheet material having a discontinuous adhesive attached thereto.

In yet another embodiment as depicted in FIG. 19 and FIG. 20, the cover sheet 60 has an adhesive 74 or a discontinuous adhesive 75 on at least one surface. The adhesive may be a thermally activated, or a lower melting polymer than that of the cover sheet, or a chemically bonding adhesive that is activated over time, or with moisture or heat or the like. In addition, the adhesive may be formulated to act with a primer that is coated on either another cover sheet surface or the support member. The two mating surfaces may comprise adhesives that react with one another to bond more effectively.

Figure 22:
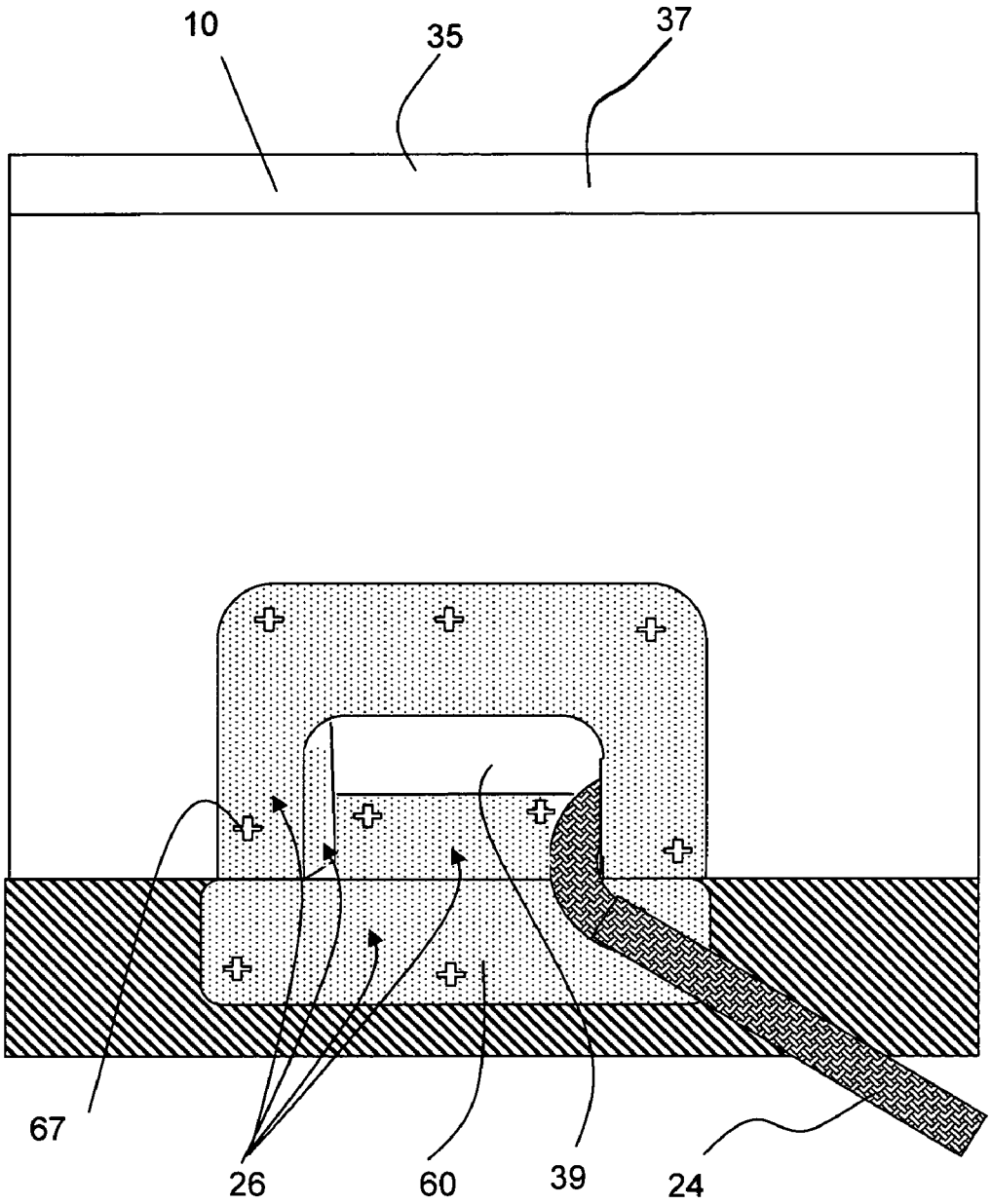
FIG. 22 is an isometric view of a marine structure with cover sheets attached thereto.

In yet another embodiment as depicted in FIG. 22, the cover sheet 60 can be applied to the surface of a support member 37 with a fastener 67, such as a bolt or screw or other fastening device. The fasteners 67 as depicted in FIG. 22 act as another type of twist resistant feature. Alternatively, the cover sheet depicted in FIG. 22 could be attached or secured to the surface of the support member with an adhesive, primer or combination thereof.

In yet another embodiment, preferably on cylindrical support members having at least one end exposed, the cover sheet may comprise a heat shrinkable polymer as described in U.S. Pat. No. 6,471,627 to Chapman, et al.

It is important that the cover sheet be impermeable because the support structures are exposed to severe conditions, and the ropes themselves can become wet with salt water. The support structures consist essentially of metal that can deteriorate in severe conditions and therefore need to be covered with material that is impermeable to water and moisture. For the purposes of this invention, an impermeable cover comprising cover sheets having a gurley value of 300 seconds or more is considered impermeable. A gurley time value can be measured on a small section of cover sheet material removed from the covered support member, or on section of cover sheet material before it is applied or attached to the support member. The gurley air flow test measures the time in seconds for 100 cc of air to flow through a sample area of 6.45 $cm^2$ at a pressure of 12.4 inches of water, and can be measured using a Densometer Model 4340 Automatic Densometer, available from Gurely Precision Instruments (Troy, N.Y.).

Suitable cover sheet materials include but are not limited to ultra high molecular weight polyethylene (UHMWPE), or the like. The cover sheet is preferably made with a material that is extremely durable and abrasion resistant, and has a low coefficient of friction. UHMWPE is further defined as having a molecular weight of greater than 1.5 million, preferably greater than 3.0 million, such as 4 to 6 million or between 1.5 and 6.0 million. The cover sheets may be tubular or flat sheets and may comprise a single layer of material, such as in a molded piece, or may comprise multiple layers. The cover sheets must be thick enough to provide effective protection to the marine structure, such as greater than 5 mm, greater than 10 mm, greater than 25 mm, or between 5 and 30 mm thick. In one embodiment the cover sheet further comprises one or more types of filler, and in some cases the filler is electrically conductive such that heat can be generated by passing current through the cover sheet. The cover sheet is considered to consist essentially of UHMWPE when the seam area comprises another polymer, for example high molecular weight polyethylene (HMWPE).

DEFINITIONS

Marine vessel as used herein includes but is not limited to a ship, boat, barge, tug boat, or any other vessel designed for water passage.

Marine structure as used herein is defined as any structure attached to, or part of, the deck of a ship or dock that is used for the directing, retaining, positioning or fastening of ropes and includes but is not limited to a fairlead, bullnose, H-bit, side-bit, or cleat. When the marine structure is attached to the marine vessel or dock, it may be welded, bolted or otherwise fastened securely. In some embodiments the marine structure consists essentially of metal, meaning that the support structures a primarily made of metal.

Dock Structure as used herein consists essentially of metal and is defined as a type of marine structure that is located on a dock or on land; as opposed to being located on a marine vessel and the dock structure consists essentially of metal. In some embodiments the dock structure consists of metal.

Cover Sheet as used herein is defined as a layer or layers of polymer film or sheet that is applied to the marine structure and is impermeable to gas as defined by having a Gurley value of at least 300 seconds. A cover sheet may comprise a tape that is wrapped directly onto the marine structure, a formed tube, a heat shrinkable tube, a molded or extruded tube, or any combination thereof. In a preferred embodiment, the cover sheet consists of UHMWPE film. A cover sheet as used herein is not a spray or solvated material applied to the marine structure.

Rope contact surface as used herein is defined as an outer surface of a marine deck structure that experience, rope contact for the purpose of directing, positioning, retaining, or fastening.

Rope as used herein is defined as any flexible line or cable used for retaining or towing a marine vessel and includes but is not limited to braided or twisted line, cable or rope comprising natural or synthetic fibers or filaments, or combinations thereof. Ropes in one embodiment have a circular cross section and a diameter of at least 1 cm, at least 5 cm, at least 30 cm or between 1 cm and 30 cm.

Support member as used herein is defined as any marine structure or part thereof that is used for the purposes of directing, positioning, retaining, or fastening ropes.

Cylindrical Support member as used herein is defined as a structure that is cylindrical in shape at least over a portion of the length and has an outer diameter and length. It may be connected to other cylindrically shaped support members to form a marine deck structure such as a bullnose, H-bit or Side bit. In some embodiments, the cylindrical support member is attached to the deck of a ship or dock on at least one end. Furthermore, the cylindrically shaped member may be arced or curved, or may comprise straight sections of length. A fairlead roller is another type of cylindrical support member.

Twist resistant feature as used herein is defined as an element that prevents the impermeable cover from moving or rotating after installation and includes but is not limited to mechanical or chemical attachments, such as an adhesive, a mechanical stop attached to the support member, or a fastener that penetrates the cover and attaches to the support member, such as a screw or bolt.

Impermeable cover as used herein is defined in one embodiment as a cover that encapsulates a support member of a marine deck structure and is made of a cover sheet material having no bulk flow to air or gas as determined by having a gurley value greater than 300 seconds. In another embodiment, the impermeable cover is securely attached to the surface of a support member or marine structure and the cover material has no bulk flow to air or gas as determined by having a gurley value greater than 300 seconds.

Multilayer tape as used herein is defined as a tape comprising at least 2 layers of tape attached or bonded together. In some embodiments a tape is wrapped around a mandrel and bonded to form a multilayer cover sheet that can be removed from the mandrel and used as an impermeable cover.

UHMWPE as used herein is defined as a polymer consisting essentially of polyethylene having a molecular weight greater than 1.5 million, preferably greater than 3.0 million, such as 4 to 6 million or between 1.5 and 6.0 million Adhesive Seam as used herein is defined as an area of attachment of edges of cover sheets, wherein the edges are attached by at least one polymer or adhesive that is different than the polymer of the cover sheet. In one embodiment the cover sheets consists essentially of UHMWPE and the edges are attached by high molecular weight polyethylene.

Integral Seam as used herein is defined as the area of attachment of edges of cover sheets wherein the attachment consists essentially of fused polymer of the cover sheets.

Smooth profile as used herein is defined as a surface having protrusions of no more than 3 mm, and preferably no more than 1 mm normal to the surface plane.

Bullnose as used herein is defined as a marine deck structure generally defined by a single arced cylindrically shaped member having a first and second end attached to the marine deck and is used for retaining or directing ropes.

H-bit as used herein is defined as a marine deck structure generally defined by multiple cylindrically shaped members; two vertical cylindrically shaped members having one end attached to the marine deck and one horizontal cylindrically shaped member being attached between the two vertical cylindrically shaped members at some distance above the marine deck. The H-bit is generally used for retaining or directing ropes.

Side bit as used herein is defined as a marine deck structure generally defined by one vertically oriented cylindrically shaped member having one end attached to the marine deck, and in some cases has a second smaller diameter cylindrically shaped member, which is often referred to as a stopper, attached to the vertical cylindrically shaped member such that the axis of the second cylindrically shaped member is perpendicular to the axis of the vertical cylindrically shaped member.

Fairlead as used herein is defined as any opening in a marine structure through which a rope is guided, such as but not limited to those depicted in FIGS. 3, 4, 6 and 8. The fair lead may be a separate structure or piece of hardware, or it could be a hole in the structure.

Fairlead roller as used herein is defined as a type of marine structure, and in particular a type or part of a fairlead comprising a cylindrically shaped member that in most cases is designed to rotate as the rope is moved across its surface to more effectively reduce wear.

Fairlead roller assembly as used herein is a type of marine structure comprising at least one fairlead roller and most typically four fairlead rollers, designed for the passage of a rope or ropes there through, and for the rope or ropes to be guided by the fairlead roll or rollers.

Panama Chock as used herein is defined as a marine support structure having an opening intended for the passage of a rope for directing, positioning, and retaining as depicted in FIG. 8 and FIG. 22.

Dock structure as used herein is defined as a type of marine support structure located on a dock that is used for the directing, positioning, retaining, or fastening of ropes.

Fixed and inaccessible as used herein is defined as a type of end of a marine deck structure where the end is not exposed and accessible, such that a tube could not be slid over the end.

Fused as used herein is defined as a state of two layers of polymeric material having an interface, wherein the layers are attached directly to each other through the use of heat.

Chaffing Surface as used herein is defined as any surface that a rope routinely contacts and may be on a marine vessel or on a dock, and may be made of any type of material including but not limited to, metal, wood, or concrete.

Attached to the deck, of the ship or dock as used herein with regard to an end of a marine structure means that the end is fixed or inaccessible. It may be for example, attached to the ship or pass through a plane such as the deck or wall, on the ship or dock therein making the end inaccessible. In some embodiments, the marine structure passes through the deck of the marine vessel and is attached at the hull for more support.

The following examples are intended to be illustrative of the invention, but are not to be construed as limiting in scope of the invention.

EXAMPLE 1

A steel bullnose on a tug boat having a cylindrical support member with a diameter of approximately 25 cm was covered with an impermeable cover comprising approximately 9 mm thick cover sheets of UHMWPE. The cover sheets for the straight sections of the bullnose adjacent the ends, as depicted in FIG. 9, were prepared by forming approximately 9 mm thick sheets of UHMWPE available from Thyssen-Krupp/Ain Plastics (Lancaster, Pa.) around a steel mandrel and heating to approximately 400° C. for approximately 20 minutes. The elbow or curved cover sheet sections, as depicted in FIG. 9, were prepared by spraying a steel elbow mandrel with Lock Tight, 700NC, and then wrapping the mandrel with 5 cm wide by 0.25 mm thick UHMWPE film from Dewal Industries (Saunderstown, R.I.), until the desired thickness was achieved. The wrapped mandrel was then placed into an oven and heated to approximately 400° C. for approximately 15 minutes or until the UHMWPE became translucent. The wrapped mandrel was then removed from the oven, cooled, and sanded to reduce the thickness of the inner radius of the elbow and to smooth the surface.

The bullnose was first cleaned and sanded to remove any debris, rough edges and raised section. Four cover sheets in tubular form were used to cover the bullnose, as depicted in FIG. 9. Two short straight cover sheets and two curved or elbow cover sheets were positioned around the bullnose and aligned. The elbow cover sheets were positioned such that the axial seam was outside of the rope contact surface as depicted in FIG. 9. Four small rectangular steel blocks, 6 mm wide, by 25 cm long by 6 cm thick, were spot welded to the bullnose as depicted in FIG. 9. The cover sheets were clamped and held tightly in place to minimize the seam area before an approximately 4 mm diameter bead of high molecular weight polyethylene (HMWPE) available from Village Plastics (Norton, Ohio), was melted and extruded into the seam area using a Stargun extruder welder model BT900TR available from Ritmo America (Lake Wales, Fla.). The seam was compressed by the tip of the extruder welder as the bead was melted into place. A metal bar approximately 2.54 cm in diameter was thereafter rolled across the seam to press the bead flush with the cover sheets. The seams were then sanded until a smooth profile as defined herein was achieved. A covered bullnose was produced having an impermeable cover with adhesive seams and four twist resistant features.

EXAMPLE 2

Figure 24A:
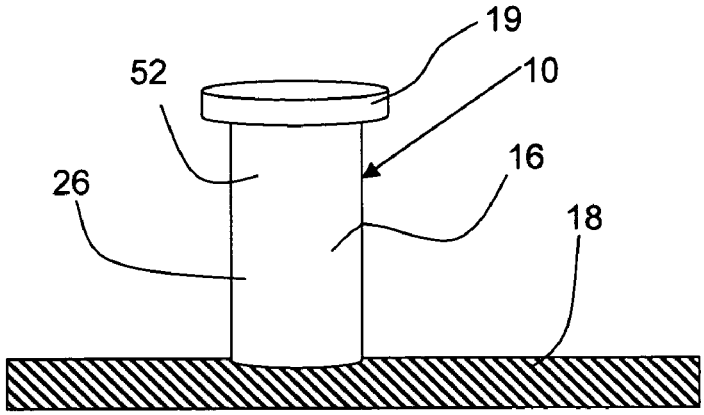
FIG. 24A is an isometric view of a side bite.
Figure 24B:
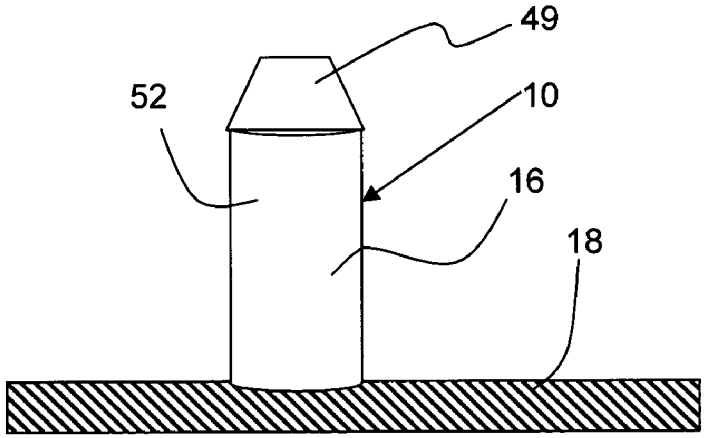
FIG. 24B is an isometric view of a side bite with the cap removed and a cone position thereon.
Figure 24C:
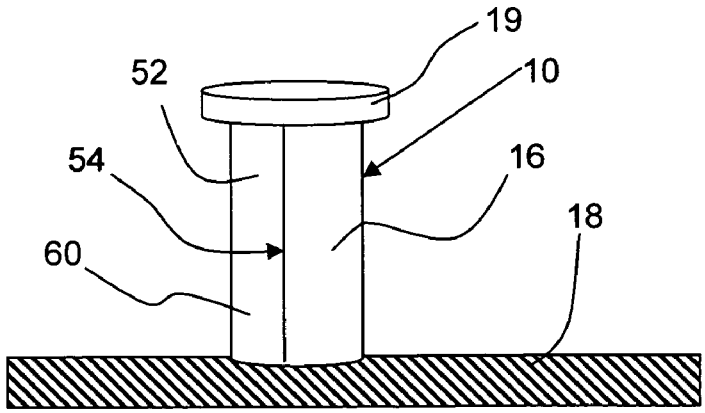
FIG. 24C is an isometric view of a side bite with an impermeable cover.

A steel side bit 16 on a tug boat having a single main cylindrical support member 52 with a diameter of approximately 25 cm as depicted in FIG. 24A, is covered with an impermeable cover using an approximately 9 mm thick cover sheet of UHMWPE from Thyssen-Krupp/Ain Plastics (Lancaster, Pa.). The side bit is first cleaned and sanded to remove any debris, rough edges and raised sections. The cover sheets for the main cylindrical support member is produced by first cutting the UHMWPE sheet to the proper size, forming the sheet around a mandrel slightly smaller in diameter than the main cylindrical support member, securing in place and heating to 400° F. for approximately 15 minutes. This initially forms the cover sheet into the correct shape. The axial edges of the cover sheet are then fused by aligning the edges and providing sufficient heat and pressure for a sufficient time to fuse together and produce a cover sheet having an integral seam. Commercially available equipment such as butt welding machines from Wegener International (Aachen, Germany) can be used to create the integral seam by clamping the cover sheet, heating the edges of the cover sheet to a sufficient temperature and applying pressure to the cover sheet after or during heating. The cap 19 on the side bit 16 is cut off and removed, and a cone 49 as depicted in FIG. 24B is positioned to guide and stretch the cover sheet over the side bit. The cover sheet is then heated to approximately 250° F. to thermally expand it, allowing it to more easily slide over the cone and over the side bit. As the cover sheet cools, it retracts and becomes firmly attached to the cylindrical support member. The cap is then attached, producing a side bit, having an impermeable cover.

In an alternate embodiment the cover sheet is not heated but is press-fitted over the cone and over the side bit. In this embodiment the cover sheet should have a wall thickness substantially thick enough, such as greater than 9 mm, to prevent buckling as the cover sheet is forced over the side bit.

EXAMPLE 3

Figure 13:
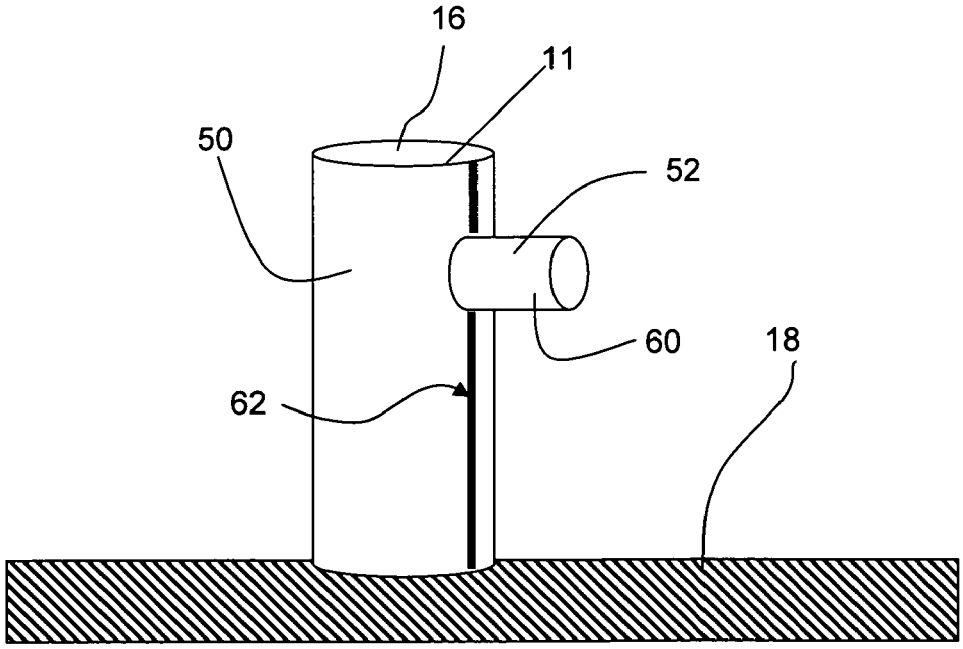
FIG. 13 is an isometric view of a side bit with an impermeable cover multiple cover sheets attached thereto.

A steel side bit on a tug boat having a main cylindrical support member with a diameter of approximately 25 cm and a stopper of approximately 10 cm, as depicted in FIG. 13, is covered with an impermeable cover using approximately 9 mm thick cover sheets of UHMWPE. The side bit is first cleaned and sanded to remove any debris, rough edges and raised sections. The cover sheets for the main cylindrical support member is produced by first covering a 25 cm diameter steel mandrel with polyimide film 0.07 mm thick, cigarette wrapping 0.25 mm thick UHMWPE sheet approximately 40 times, covering the wrapped mandrel with a release film of polyimide film 0.07 mm thick, spirally wrapping insulated fiberglass heating tape, Omegalux, (Omega, Stamford, Conn.), and heating to approximately 210° C. for approximately 3 hours. The heating tape and outer release film are then removed and the cover sheet is removed from the mandrel by cutting it along the axis to produce a multilayer tubular cover sheet of approximately the same inner diameter of that of the main cylindrical support member of the side bit. The multilayer cover sheet produced in this manner is then positioned around the side bit, such that the seam is positioned in alignment with the stopper as depicted in FIG. 13. Additional material is removed from the multilayer cover sheet so that it will fit properly around the stopper. A UHMWPE tubular cover sheet approximately 75 cm in diameter and approximately 9 mm thick, Thyssen-Krupp/Ain Plastics (Lancaster, Pa.) is then slid over the stopper and again material is removed so it will fit tightly against the main cylindrical support member. The two cover sheets are then clamped in order to pull the edges together and the seam is made using a Stargun extruder welder model BT900TR available from Ritmo America (Lake Wales, Fla.). The seam is compressed by the tip of the extruder welder as the edges are fused together creating an integral seam. The seams is then sanded using a Porter cable #343 Orbit sander (Jackson, Tenn.), until a smooth profile as defined herein is achieved. A covered side bit is produced having an impermeable cover with integral seams.

EXAMPLE 4

Figure 15:
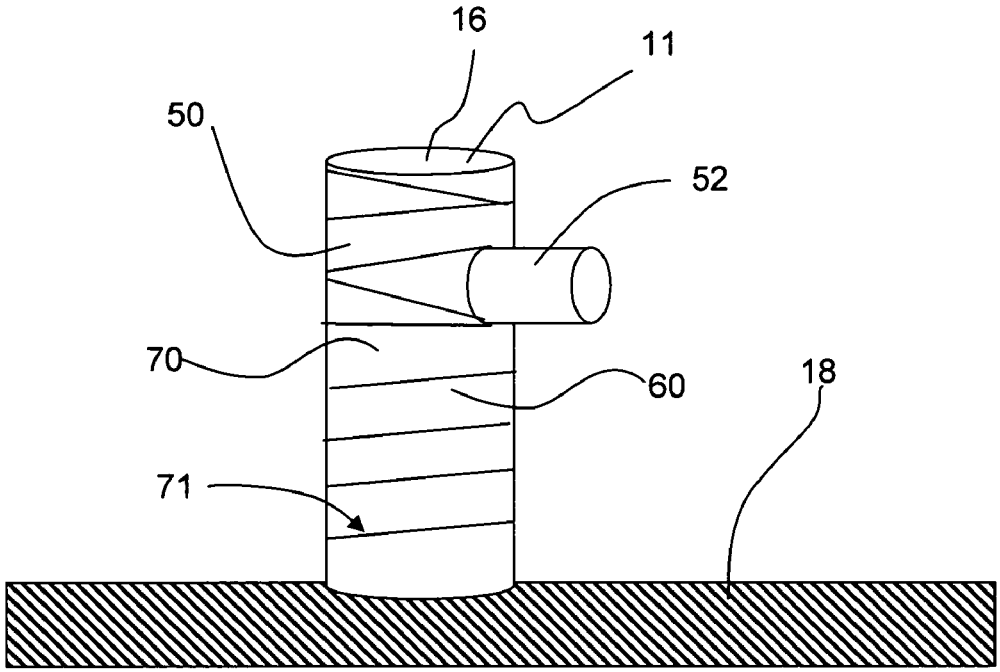
FIG. 15 is an isometric view of a side bit with a spirally wrapped cover sheet attached thereto.
Figure 16:
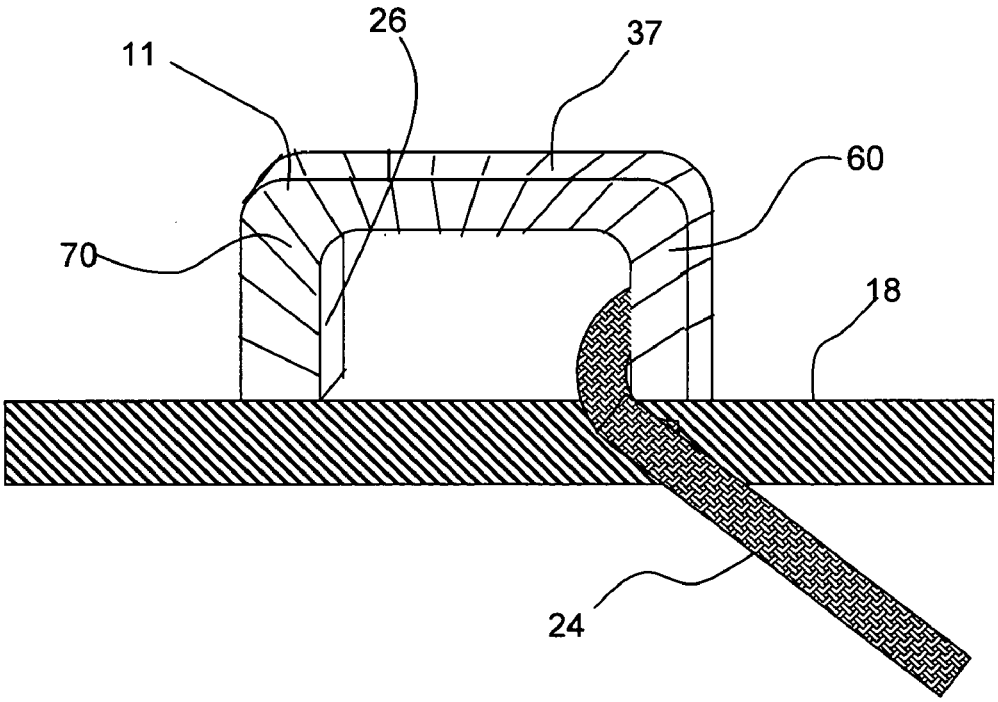
FIG. 16 is an isometric view of a another type of marine structure with a spirally wrapped cover sheet attached thereto.

A side bit is covered with an impermeable cover by first removing the cap and cleaning and sanding to remove any debris, rough edges and raised sections. The side bit is then spirally wrapped with a cover sheet material, 5 cm wide by 0.25 mm thick UHMWPE film from Dewal Industries (Saunderstown, R.I.). The cover sheet is wrapped until a thickness of approximately 9 mm is achieved, as depicted in FIG. 15. The side bit is then spirally wrapped with a polyimide release film and then an insulated fiberglass heating tape, Omegalux, (Omega, Stamford, Conn.), and heated to approximately 204° C. for approximately 3 hours. During this heat cycle, the inside of the side bit is heated using a torch, such as a "Hotspotters" Model WB-101, from Western Enterprises (Westlake, Ohio). The torch is slowly moved over the inside surface of the support member. The heating w and polyimide release film is removed producing a side bit having an impermeable cover.

EXAMPLE 5

A side bit is covered with an impermeable cover by making a multilayer cover sheet, heating it and sliding it over the cylindrical support member. A tubular cover sheet is produced by spirally wrapping a cover sheet material, 5 cm wide by 0.25 mm thick UHMWPE film from Dewal Industries (Saunderstown, R.I.) around a mandrel slightly smaller in diameter than the main cylindrical support member, securing in place and heating to 400° F. for approximately 15 minutes. The side bit is first cleaned and sanded to remove any debris, rough edges and raised sections. The cap 19 on the side bit 16 is cut off and removed, and a cone 49 as depicted in FIG. 24B is positioned to guide and stretch the cover sheet over the side bit. The cover sheet is then heated using a torch, such as a "Hotspotters" Model WB-101, from Western Enterprises (Westlake, Ohio), and slid over the cone and over the side bit. The cover sheet is then heated to approximately 250° F. to thermally expand it, allowing it to more easily slide over the cone and over the side bit. As the cover sheet cools, it retracts and is firmly attached to the cylindrical support member.

EXAMPLE 6

A side bit is covered with an impermeable cover by making a heat shrinkable multilayer cover sheet, sliding it over the cylindrical support member and heating it to retract it and attach it to the side bit. A tubular cover sheet is produced by spirally wrapping a cover sheet material, 5 cm wide by 0.25 mm thick UHMWPE film from Dewal Industries (Saunderstown, R.I.) around an expandable mandrel slightly smaller in diameter than the main cylindrical support member, securing it in place and heating to 105° C. for approximately 15 minutes and then expanding the mandrel diameter approximately 2 to 50% and typically about 10% and then allowing it to cool in the expanded state. The side bit is first cleaned and sanded to remove any debris, rough edges and raised sections. The cap 19 on the side bit 16 is cut off and removed, and a cone 49 as depicted in FIG. 246 is positioned to guide the cover sheet over the side bit. The cover sheet is then slid over the cone and over the side bit. The cover sheet is then heated to approximately 105° C. for approximately 15 minutes until the cover sheet retracts and compresses to the support. The cap is then attached, producing a side bit, having a multilayer impermeable cover.

EXAMPLE 7

I

Figure 21:
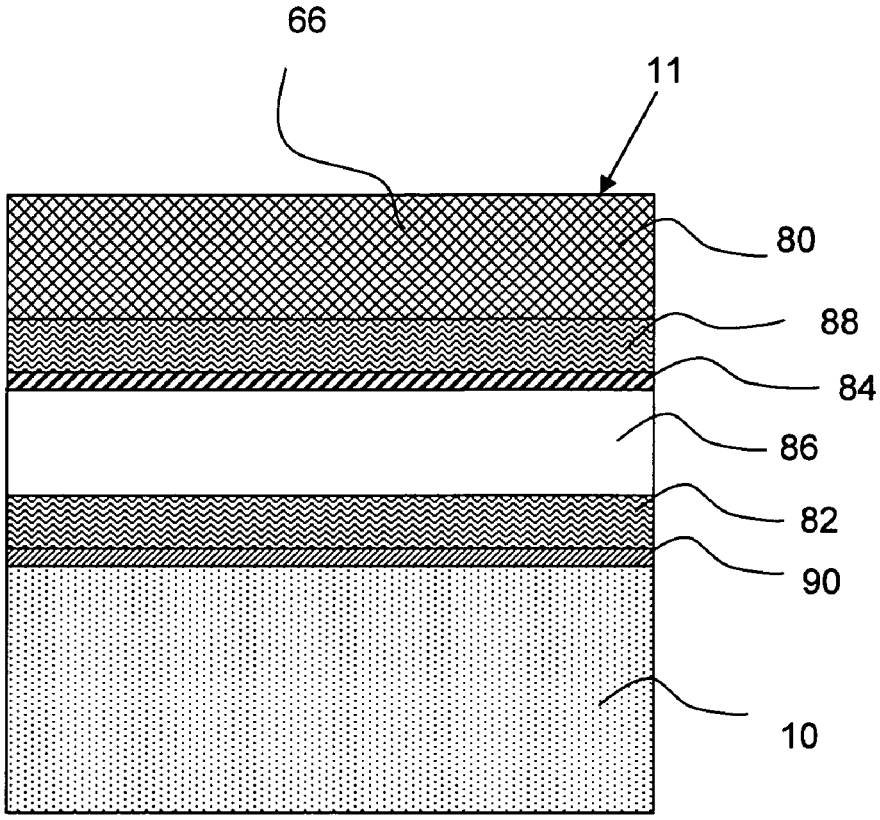
FIG. 21 is a cross section view of a section of a marine structure and cover sheet.

In one embodiment the impermeable cover 66 is applied to the marine support structure 10 by first applying an electrical insulator 90 to the surface of the support structure 10, and then applying a first heating tape 82, over the insulator, then applying the cover sheet 86, followed by a release material 84 such as polyimide film, a second heating tape 88, and lastly a compression material 80, as depicted in FIG. 21. After all of these layers are applied to the structure, the heating tapes can be turned on and the cover sheet can be effectively heated and fused or bonded together between layers or in seam areas. After the impermeable cover has been formed, the compression material, second heating tape and release material are removed. The seams can then be sanded using Porter cable #343 Orbit sander (Jackson, Tenn.), until a smooth profile as defined herein is achieved. A covered marine structure is produced having an impermeable cover.

EXAMPLE 8

A covered marine structure was produced as depicted in FIG. 22. The opening 39 in the deck wall 35, and the surrounding rope contact area 26, was covered with UHMWPE sheets, approximately 9 mm thick Thyssen-Krupp/Ain Plastics (Lancaster, Pa.). The opening and surrounding area was first cleaned and sanded to remove any debris, rough edges and raised sections. The cover sheet material was cut into three sections and positioned in and around the opening 39, and the edges were aligned. The adhesives Armstrong A-12 Parts A & B available from Ellsworth Adhesives Inc., (Woburn, Mass.) was applied to the seams or along the adjoining edges of the cover sheet material. Pilot holes were drilled through the cover sheet material and into the marine structure. Screw type fasteners 67 were positioned and secured through the cover sheet and into the marine structure as depicted in FIG. 22. The seams were then sanded using a Porter cable #343 Orbit sander (Jackson, Tenn.), until a smooth profile as defined herein was achieved. A covered marine structure was produced having an impermeable cover.

EXAMPLE 9

Figure 26:
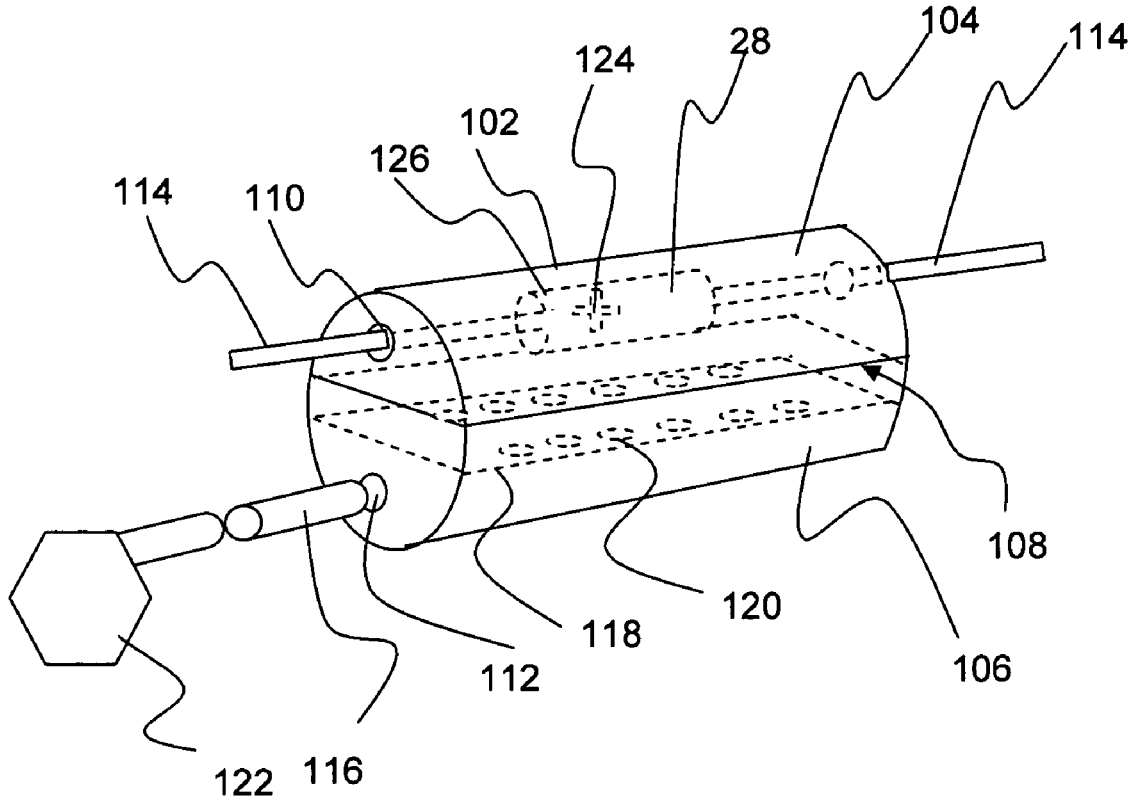
FIG. 26 is an isometric view of an in situ heater device.

A fairlead roller approximately 150 mm in diameters was removed from a fairlead assembly on a marine vessel and a heat shrinkable cylinder of UHMWPE as described in U.S. Pat. No. 6,471,627 to Chapman and having an approximately 170 mm inner diameter and a 1.5 mm wall thickness was located around the fairlead roller. The covered fairlead roller 128 was then placed into an in situ heater device 102 having a first compartment 104, second compartment 106, connected by a hinge 108 as depicted in FIG. 26. The covered fairlead roller 128 was suspended inside the heater device 102 on a shaft 114, and a thermocouple 124 was placed on the surface of the heat shrinkable cylinder 126, as depicted in FIG. 26. A heater 122, Hotspotters Model WB-101, from Western Enterprises (Westlake, Ohio), was connected to a tube extension 116 which was placed at the opening 112 in the second compartment having a heat shield 118 and heat shield openings to allow the heat into the first compartment 104 in a uniform and gradual manner, as depicted in FIG. 26. The heater was turned on, and the surface of the heat shrinkable cylinder was brought to approximately 250° F. and held for approximately 10 minutes by adjusting the heater. The heat and time was sufficient to cause the heat shrinkable cover to retract and become securely attached to the fairlead roller. A covered fairlead roller was produced having an impermeable UHMWPE cover.

While particular embodiments of the present invention have been illustrated and described herein, the present invention should not be limited to such illustrations and descriptions. It should be apparent that changes and modifications may be incorporated and embodied as part of the present invention within the scope of the following claims.

We claim:

1. A marine structure for rope contact comprising, a. at least one support member comprising:

i. at least one rope contact surface;

ii. an impermeable cover over at least a portion of the support member comprising at least one cover sheet;

iii. a first end and a second end;

wherein the marine structure for rope contact is attached to or part of a marine vessel or dock, wherein at least one of the said ends is fixed and inaccessible, wherein the impermeable cover is securely attached to and covers at least a portion of the support member and has no bulk flow to gas and wherein the impermeable cover has a smooth profile;

iv. wherein the impermeable cover comprises ultra high molecular weight polyethylene sheet material wrapped around the support member.

2. The marine structure of claim 1 wherein the support member comprises at least one cylindrically shaped support member.

3. The marine structure of claim 1 further comprising at least one twist resistant feature.

4. The marine structure of claim 1 wherein the impermeable cover further comprises a seam extending over at least a portion of the length of said support member.

5. The marine structure of claim 1 wherein both the first and second ends are fixed and inaccessible.

6. The marine structure of claim 1 wherein the marine structure is a bullnose.

7. The marine structure of claim 1 wherein the marine structure is an H-bit.

8. The marine structure of claim 1 wherein the marine structure is a side bit.

9. The marine structure of claim 1 wherein the marine structure is a fairlead.

10. The marine structure of claim 1 wherein the marine structure is a fairlead roller.

11. The marine structure of claim 1 wherein the marine structure is a dock structure for rope contact.

12. The marine structure of claim 1 wherein the impermeable cover is greater than 0.5 mm and less than 2.54 cm thick.

13. The marine structure of claim 1 wherein the impermeable cover consists essentially of ultra high molecular weight polyethylene.

14. The marine structure of claim 1 wherein the impermeable cover comprises at least 3 cover sheets consisting essentially of ultra high molecular weight polyethylene.

15. The marine structure of claim 3 wherein the at least one twist resistant feature comprises an attachment that extends from the cover into the support member.

16. The marine structure of claim 3 comprising two twist resistant features.

17. The marine structure of claim 4 wherein the seam extends the entire length of the at least one support member.

18. The marine structure of claim 4 wherein seam comprises high molecular weight polyethylene.

19. The marine deck structure of claim 1 wherein the impermeable cover has a smooth profile having no protrusions of more than 1 mm normal to the surface plane of the impermeable cover.

20. A covered bullnose comprising:

a. a metal cylindrically shaped member having a first end and a second end that are fixed and inaccessible;

b. a length from the first end to the second end; and c. an impermeable cover comprising at least one cover sheet, wherein the covered bullnose is attached to or part of a marine vessel or dock, wherein the impermeable cover is securely attached to and encapsulates at least a portion of the covered bullnose and has no bulk flow to gas and wherein the impermeable cover has a smooth profile;

d. wherein the impermeable cover comprises of ultra high molecular weight polyethylene sheet material wrapped around the bullnose.

21. The covered bullnose of claim 20 further comprising at least one twist resistant feature.

22. The covered bullnose of claim 20 further comprising a seam extending at least a portion of the said length.

23. The covered bullnose of claim 22 wherein the seam consists essentially of high molecular weight polyethylene.

24. A method of making a covered marine structure for rope contact comprising the steps of:

a. providing at least one support member comprising:

i. a length from a first end to a second end;

ii. at least one rope contact surface;

b. providing at least one cover sheet;

c. covering said at least one support member with said at least one cover sheet having a $1^{st}$ edge and a $2^{nd}$ edge and a end and a $2^{nd}$ end;

d. orienting the edges of cover sheet or sheets to form aligned edges;

e. producing a welded seam by placing, heating, and melting a bead of materal into the aligned edges of the cover sheet or sheets and applying pressure; and f. removing any raised areas from the welded seam to produce an impermeable cover having a smooth profile on a support member, wherein the covered marine structure for rope contact is attached to or part of a marine vessel or dock, wherein at least one of the said ends is fixed and inaccessible, and wherein the impermeable cover is securely attached to and covers at least a portion of the support member and has no bulk flow to gas.

* * * * *